United States Patent [19]

Tomisawa et al.

[11] Patent Number: 4,524,668

[45] Date of Patent: Jun. 25, 1985

[54] ELECTRONIC MUSICAL INSTRUMENT CAPABLE OF PERFORMING NATURAL SLUR EFFECT

[75] Inventors: Norio Tomisawa; Yasuji Uchiyama; Hideo Suzuki, all of Shizuoka, Japan

[73] Assignee: Nippon Gakki Seizo Kabushiki Kaisha, Hamamatsu, Japan

[21] Appl. No.: 434,604

[22] Filed: Oct. 15, 1982

[30] Foreign Application Priority Data

Oct. 15, 1981 [JP] Japan ..... 56-163509

[51] Int. Cl.[3] ..... G10H 1/053; G10H 7/00

[52] U.S. Cl. ..... 84/1.24; 84/1.27

[58] Field of Search ..... 84/1.09–1.13, 84/1.24–1.27

[56] References Cited

U.S. PATENT DOCUMENTS

| | | | |
|---|---|---|---|
| 3,908,504 | 9/1975 | Deutsch | 84/1.26 X |
| 4,152,966 | 5/1979 | Deutsch | 84/1.24 |
| 4,214,503 | 7/1980 | Deutsch | 84/1.27 |
| 4,237,764 | 12/1980 | Suzuki | 84/1.24 |
| 4,273,018 | 6/1981 | Deutsch | 84/1.27 X |
| 4,300,434 | 11/1981 | Deutsch | 84/1.27 X |
| 4,332,183 | 6/1982 | Deutsch | 84/1.26 |

FOREIGN PATENT DOCUMENTS 107722 8/1979 Japan .

*Primary Examiner*—S. J. Witkowski

*Attorney, Agent, or Firm*—Spensley Horn Jubas & Lubitz

[57] ABSTRACT

An electronic musical instrument comprises means for detecting depressed-keys on a keyboard to generate key informations corresponding to said depressed keys, and means for generating a musical tone signal which varies pitch from the pitch of a musical tone generated by a firstly-depressed key to the pitch of a musical tone generated by a secondly-depressed key, in accordance with a key information of said firstly-depressed key and a key information of said secondly-depressed key. In the instrument, means is provided for generating an amplitude coefficient which sequentialy varies from an amplitude of the musical tone generated by the firstly-depressed key to an amplitude of the musical tone generated by the secondly-depressed key whereby the amplitude of said musical tone signal is controlled according to said amplitude coefficient.

23 Claims, 14 Drawing Figures

ELECTRONIC MUSICAL INSTRUMENT CAPABLE OF PERFORMING NATURAL SLUR EFFECT

BACKGROUND OF THE INVENTION

1. Field of the Invention

The present invention relates generally to improvements in an electronic musical instrument which is capable of imparting the natural slur effect to musial tones by smoothly changing pitch of the musical tones from that of a musical tone generated by a firstly-depressed key (the first key) to that by a secondly-depressed key (the second key).

More specifically, the invention concerns an electronic musical instrument which can eliminate such uncomfortability or unnaturality listeners feel that the musical tones imparted with the slur effect or (portamento effect) are increased or decreased in audio volume level between musical tones even if the two or more tones actually have an equal volume level, by changing the amplitude coefficient of the musical tones according to their pitches so as to control the volume level of the musical tones.

2. Description of the Prior Art

There has been so far suggested, for example, in Japanese Patent Application Laid-open No. 107722/1979 an electronic musical instrument wherein the slur effect can be imparted to musical tones by smoothly changing the pitch of the musical tones from that of a musical tone generated by the first-operated key (the first key) to that by the next-operated key (the second key).

If a player performs the slur playing operation on a natural instrument such as a guitar, the volume level of the played musical tones will be naturally varied according to the pitch of the tones, imparting the natural slur effect to the musical tones. In a slur operation, a listener generally senses that a higher-frequency tone is louder than a lower-frequency tone, even if the tones actually have an equal volume level.

Such conventional electronic musical instrument has a disadvantage in that the musical tones are varied only in pitch (frequency) and thus it is impossible to obtain a slur effect similar to that of a natural instrument, and listeners feel the slur effect uncomfortable or unnatural because they feel the volume of the tone have different levels even if these tones actually have an equal volume level.

SUMMARY OF THE INVENTION

Accordingly, it is an object of the present invention to provide an electronic musical instrument which has eliminated the above defects in the prior art and which realizes a slur effect similar to that by a natural instrument.

In accordance with a preferred embodiment of the electronic musical instrument of the present invention, the amplitude coefficient of musical tones is varied according to variations in the tone pitch to thereby control the volume level of the tones.

Another object of the invention is to provide an electronic musical instrument which imparts the slur effect regardless of the key playing operation on the keyboard.

Yet another object of the invention is to provide an electronic musical instrument which allows an adjustment of the pitch of generated musical tones not only by changing its frequency but also by changing other parameters such as key code or pitch voltage, in other words, by changing any of the parameters which determine the pitch of the generated musical tones.

A still further object of the invention is to provide an electronic musical instrument which allows a variation of amplitude coefficient of a musical tone according to variations in its pitch for its volume level control, whereby a slur effect similar to that of a natural instrument as a guitar can be realized, and which is also natural to listeners.

BRIEF DESCRIPTION OF THE DRAWINGS

The above and other objects and advantages of the present invention will become clear from the following description with reference to the accompanying drawings, in which.

DETAILED DESCRIPTION OF THE PREFERRED EMBODIMENT

Figure 1:
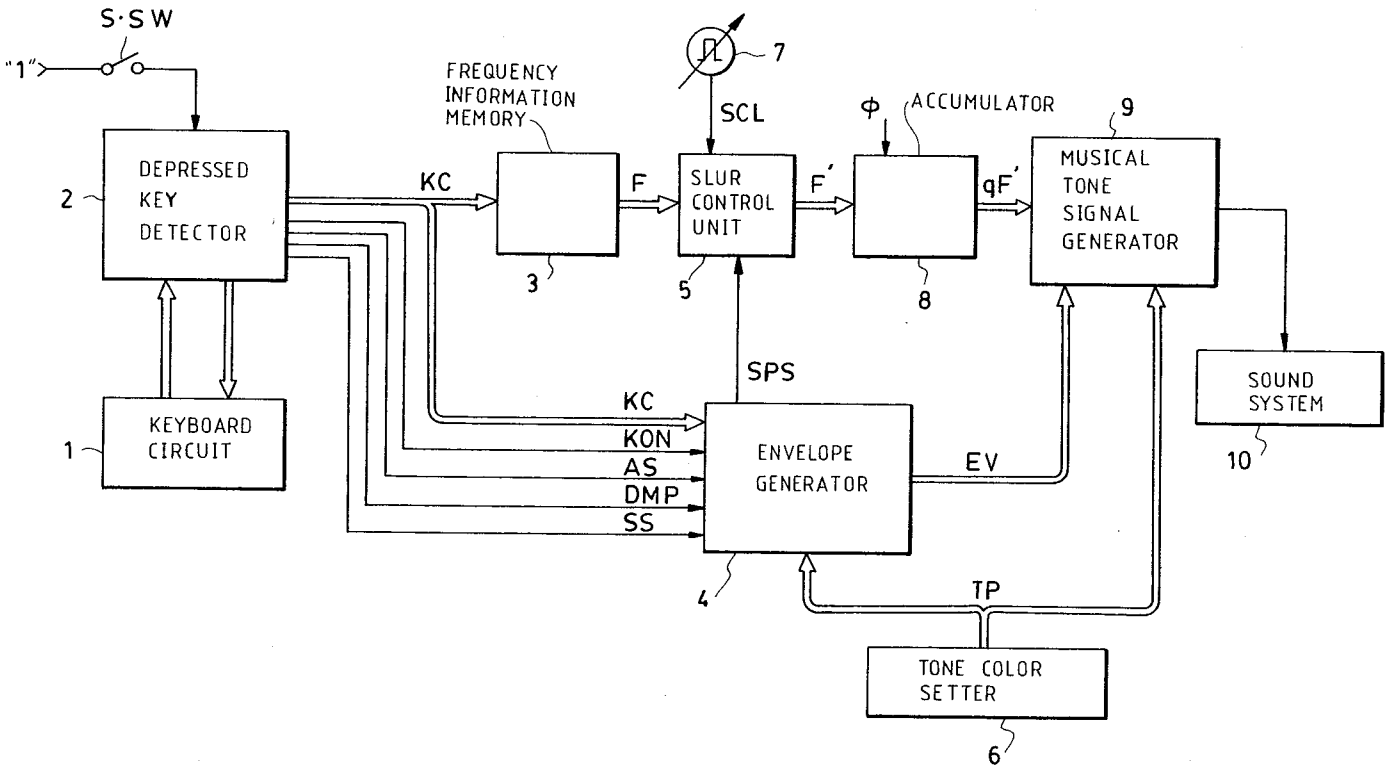
FIG. 1 is a block diagram of an embodiment of an electronic musical instrument with the present invention.

Referring first to FIG. 1, there is shown a general block diagram of an embodiment of an electronic musical instrument in accordance with the present invention, wherein a keyboard circuit 1 includes key switches which are associated with respective keys in a keyboard so that depression of a key or keys causes the associated key switch or switches to be operated. The key switches are connected to a depressed-key detection circuit 2 so that the detector 2 detects key switches in operation.

The depressed-key detector 2 detects key switches of the keyboard circuit 1 in operation by sequentially scanning. It is set to be effected in a direction from the higher tone key switch to the lower tone. In this case, the depressed-key detection circuit 2 has a higher-tone priority select function and generates a key code signal KC indicative of the highest tone one out of the operating key switches detected through the sequential scanning operation. That is, since the key switches are scanned in the direction from the higher tone switch region to the lower tone region as explained above, the operating key switch first detected during each scanning cycle corresponds to the highest tone and thus the depressed-key detector 2 will generate the key code KC representative of the highest one out of the depressed tone keys.

The key code KC is comprised of a total of 7 bits, for example, bits $B_3$, $B_2$, $B_1$ indicative of octave range and bits $N_4$, $N_3$, $N_2$, $N_1$ indicative of a letter name.

The depressed-key detector 2 also generates a key-on signal KON representative of the fact that any other keys are depressed, together with the aforementioned key code signals KC.

Further, the detector 2 detects that the key operation depressed or played by an operator or player is legato or staccato, and generates a signal SS for control of slur effect and signals DMP and AS for control of an envelope waveform signal EV to control the amplitude, according to the state of the detected key operations and to the on or off state of a slur switch S.SW for impartation of the slur effect.

The staccato playing operation is that the next new key is actuated, after the first-actuated key has been released whereas, the legato playing operation is that the next new key is actuated before the first-actuated key is not released yet.

The attack start signal AS is used for generating the envelope waveform signal EV starting from its attack portion (for starting the generation of the musical tone), while, the damp instruction signal DMP is used for decaying abruptly the envelope waveform signal EV (for terminating abruptly the generation of the musical tone).

On the other hand, the slur start signal SS is used to impart the slur effect of the invention to the musical tone. In this embodiment, when the slur switch S.SW is on and the legato playing operation is made, the slur effect can be imparted and only at this time, depressed-key detection circuit 2 issues the slur start signal SS. Even if the slur switch S.SW is on, the slur start signal SS sill not be generated as long as the depressed key operation indicates the staccato playing mode. More specifically, when the slur switch S.SW is on and the depressed key operation indicates the staccato mode, the depressed-key detector 2 will generate the damp instruction signal DMP for abruptly decaying or attenuating the envelope waveform signal EV for the first-key musical tone, and also generate the attach start signal AS for starting the envelope waveform signal EV of the new second key musical tone from its attack portion.

The depressed-key detector 2 will generate a time signal after the generation of the signal DMP. If the slur switch S.SW is on and the depressed key operation indicates the legato mode, then start signal SS is used for varying the pitch of the second key musical tone at an incremental or decremental or sequential rate of a predetermined amount from the first key pitch to the second key pitch. It is further used for varying the level of the envelope waveform signal EV on the second key musical tone at an incremental or decremental (or sequential) rate of predetermined amount from the first key pitch level to the second key pitch level.

In the legato playing mode, when the first key is depressed first, the detector 2 will generate the damp instruction signal DMP and the attack start signal AS to start from the attack portion the envelope waveform signal EV on the first key in the similar way to the staccato playing mode.

On the other hand, of the slur switch S.Sw is off, then the depressed-key detector 2 will issue the attack start signal AS and the decay instruction signal DMP in the both staccato and legato modes, with the result that the envelope waveform signal EV of each key musical tone is always started from the attack portion.

In this way, the key code KC of the depressed key corresponding to the highest tone issued from the detector 2 is supplied to a frequency information memory 3 and an envelope generator 4. Also, the key-on signal KON, the attack start signal AS, the damp instruction signal DMP, and the slur start signal AS are supplied to the envelope generator 4.

The frequency informaion memory 3 beforehand stores therein a frequency information F on the pitch of the keys in the keyboard, and as soon as receiving the key code signal DC from the depressed-key detection circuit 2 as an address signal, the memory will generate the frequency information signal F on the pitch of the key indicated by the key code KC. The frequency information signal F is sent to a slur control unit 5.

Figure 2:
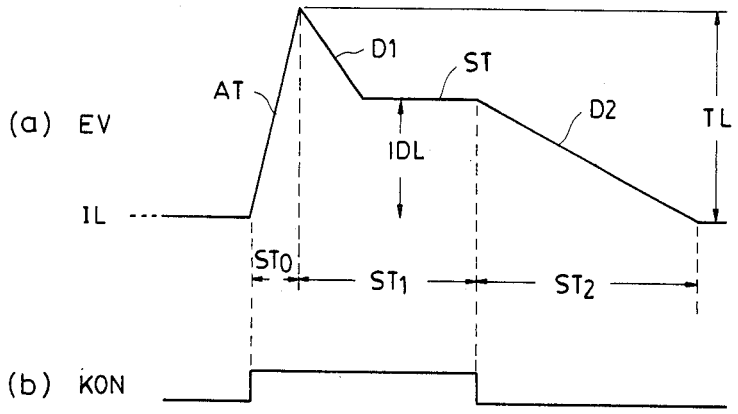
FIGS. 2 to 7 schematically show envelope waveform signals and associated timing signals appearing in the embodiment of FIG. 1.
Figure 3:
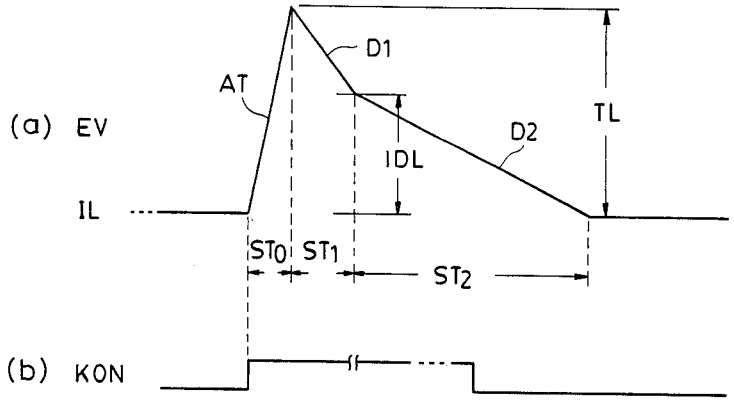

The envelope generator 4 basically receives the attack start signal AS, key-on signal KON and key code KC from the depressed-key detector. Under this condition, if the envelope generator 4 receives a tone-color parameter TP for generation of the continuous tone envelope waveform signal EV from a tone color setting circuit 6, the generator 4 will generate the envelope waveform signal EV of such a waveform as shown in FIG. 2, (*a*). When the envelope generator 4 receives the tone-color parameter signal TP for generation of the percussive envelope waveform signal EV from the tone-color setter 6, the generator will generate the envelope waveform signal EV of such a waveform as illustrated in FIG. 3, (*a*).

Figure 8:
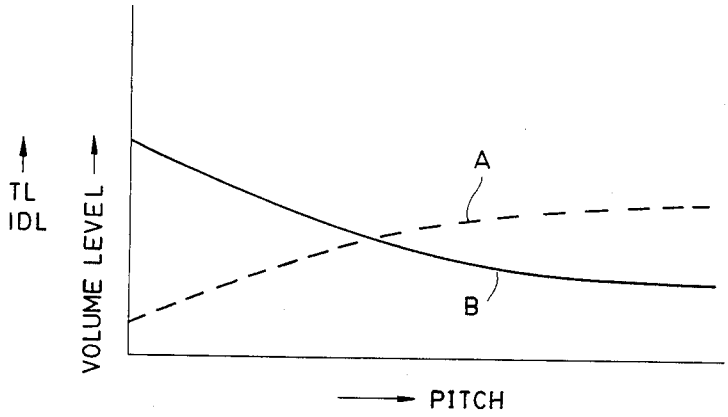
FIG. 8 is a characteristic diagram showing a relation between the volume and pitch of an envelope waveform signal with respect to man's audible volume level and the target value B of the envelope signal.

The envelope generator 4 used in the invention is so adjusted that the final values or levels TL and IDL of such segments as the attack portion AT and the first decay portion D1 are different as shown with a solid line B in FIG. 8, depending on the different key codes KC, taking into consideration the fact that, in the man's hearing sense, as the pitch of a musical tone becomes higher, the volume level becomes higher as shown by a broken line A in a charactristic graph of FIG. 8. In other words, the final levels TL and IDL of the attack segment AT and first decay segment D1 are set to be lower sequentially as the depressed key (the depressed highest-tone key) becomes higher in pitch. This enables men or women to listen to the musical tone always at a constant volume level even if the pitch of the depressed key varies.

Figure 4:
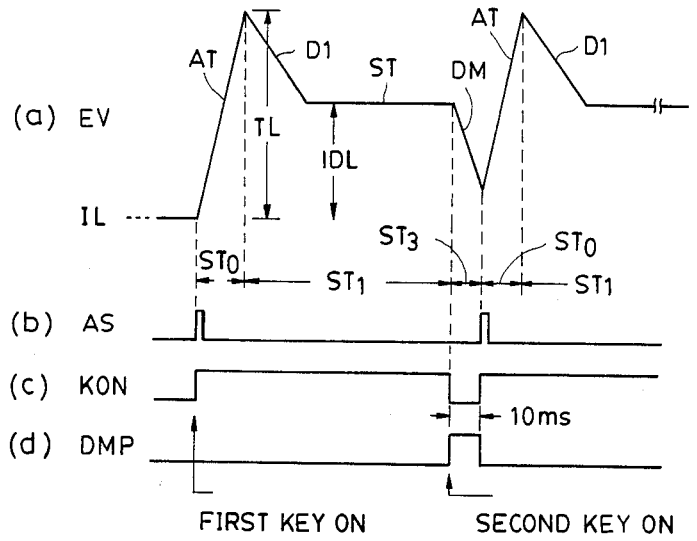
Figure 5:
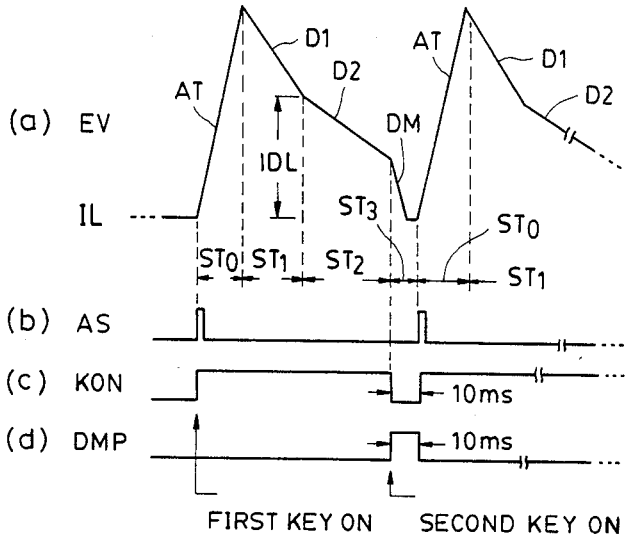

As long as the envelope generator 4 receives the tone-color parameter signal TP from the tone-color setting circuit 6 for generation of the continuous envelope waveform signal, the playing operation without the slur effect can be achieved, that is, the staccato playing mode or the legato playing mode with the slur switch S.SW turned off can be obtained. Under this condition, if the envelope generator 4 receives the damp instruction signal DMP, key code signal KC, key-on signal KON and attack start signal AS from the depressed key detection circuit 2, then the envelope waveform signal EV on the previous key (the first key) will be abruptly attenuated or dropped by the damp instruction signal DMP for a predetermined period of time (10 ms, in this embodiment) at a selected rate, as shown by DM in FIG. 4, (*a*), and subsequently the envelope generator 4 will generate the envelope wave form signal EV on the newly-depressed key (the second key) by the attack start signal AS, starting from its attack portion AT. As long as the generator 4 receives the tone-color parameter TP from the tone-color setter 6 for generation of the percussive envelope waveform signal EV, the generator will generate the envelope waveform signal EV of such a waveform as illustrated in FIG. 5, (*a*).

Figure 6:
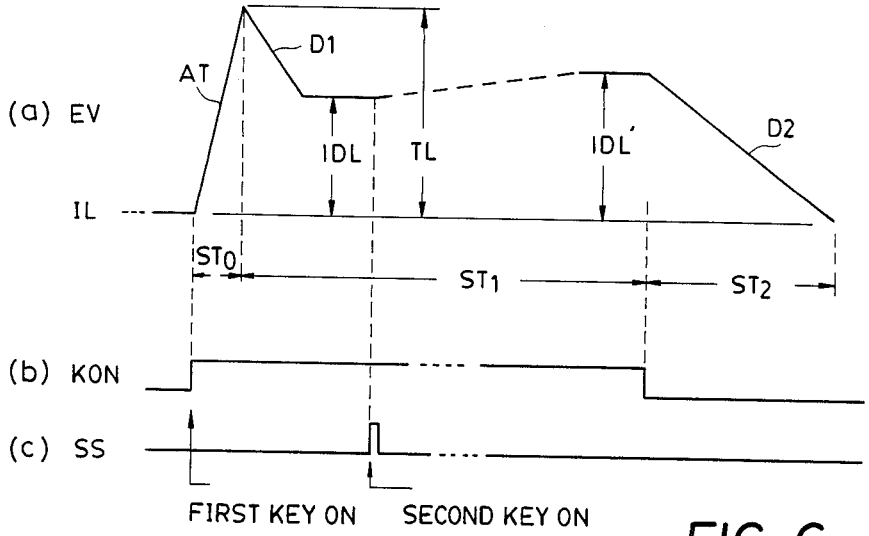
Figure 7:
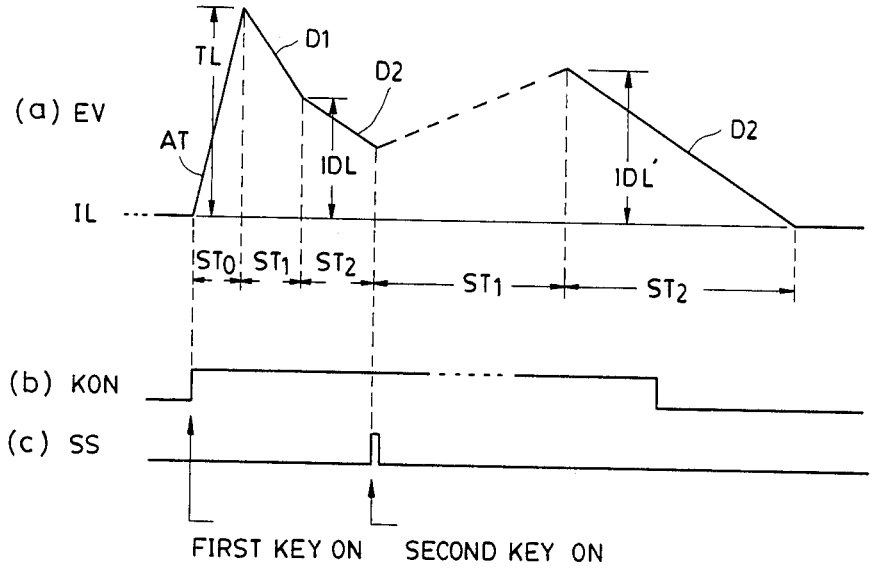

On the other hand, in the case of imparting the slur effect, i.e., when the envelope generator 4 receives the key code KC, key-on signal KON and slur start signal SS by playing legato key operations during the on state of the slur switch S.SW, the generator 4 will vary the already-generated envelope waveform signal EV of the first key in a stepped manner in orde to conform it to the envelope waveform signal EV on the newly-depressed second key. Under this condition, if the generator 4 receives the tone-color parameter TP of the continuous tone then the generator 4 will generate the envelope waveform signal EV of such a waveform as shown in FIG. 6, (*a*), and if the generator 4 receives the percussive tone-color parameter TP then the generator 4 will generate the envelope waveform signal of such a waveform as shown in FIG. 7, (*a*). In this connection, the envelope waveform signal EV on the second key starts to be varied when the slur start signal SS is generates. Assume that the attack portion At, the first decay portion D1 and the second decay portion D2 are formed respectively during the states $ST_0$, $ST_1$ and $St_2$ and that the signal Ev is abruptly dropped or attenuated by the damp instruction signal DMP during the state $ST_3$. A generation of the slur start signal SS will cause the current state to be set positively for the state $ST_1$, so that the level of the generated envelope waveform signal EV will be varied incrementally or decrementally in a stepped manner so as to make it equal to the first decay level IDL of the second key, starting with the level at the time of genration of the signal SS. For example, if the slur start signal SS generates at the sustained poriton ST of the envelope waveform signal EV on the first key, then the envelope waveform signal EV concerning the second key will be varied from the level at the time of generation of the signal SS (that is, the first decay level for the first key) toward the first decay level IDL' for the second key.

The envelope generator 4, while varying the envelope waveform signal EV in a stepped manner, will generate a slur pitch start signal SPS to instruct to vary sequentially (incrementally or decrementally) the musical tone pitch and send it to the slur control unit 5.

Next, in the normal operation of the slur control unit 5, that is, when the slur control unit 5 does not receive the slur pitch start signal SPS from the envelope generator 4, the unit 5 will supply the frequency information F of the depressed highest tone key from the frequency information memory 3 to an accumulator 8, in the form of an information F'.

On the other hand, if the unit 5 receives the slur pitch start signal SPS, then the unit will vary the frequency information F' so far generated at a selected rate in a stepped fashion, until the information F' becomes equal to the target frequency information F entered through a new depression operation. This can be achieved by finding a difference signal $D(=F-F')$ between the frequency information F' and the target frequency information F, multiplying the difference signal D by $\frac{1}{2}^n$ through the shift operation, and adding or subtracting the multiplied value $\frac{1}{2}^n \cdot D$ to or from the information F' as a variation amount per unit time of the frequency information F'.

The above logical operation or calculation is repeated until F is equal to F'. As a result, the frequency information F' will reach the frequency information F about the newly depressed key after $2^n$ calculations or operations have been executed. In this case, the calculation $(F' \pm \frac{1}{2}^n \cdot D)$ is carried out each time a slur clock oscillator 7 generates a slur clock signal SCL. Therefore, the frequency information F' is varied incrementally or decrementally at a rate corresponding to the period of the slur clock signal SCL.

The accumulator 8 will accumulate the frequency information F' supplied from the slur control unit 5 each time the accumulator receives a clock pulse $\phi$ having a predetermined period, will generate a cyclical accumulative value $qF'(q=1,2,\ldots)$ proportional in amplitude to the frequency information F', and will supply the accumulative value qF' to a musical tone signal generation circuit 9.

The musical tone signal generator 9 will receive the accumulative value qF' from the accumulator 8 and the tone color parameter TP from the tone color setting circuit 6, and will form, on the basis of the signals qF' and TP, a musical tone signal which corresponds in pitch (frequency) to the cyclical period of the accumulative value qF' and corresponds in tone color to the information TP. Further, the musical tone signal generator 9 will set the amplitude of the musical tone signal according to the envelope waveform signal EV supplied from the envelope generator 4. The resultant musical tone signal is sent to an audio system 10 to sound as a musical tone. Under this condition, the slur switch S.SW remains on and that the legato playing operation is conducted, the musical tone will be sequentially varied in its pitch in response to seqential changes in the frequency information F' supplied via the slur control unit 5, which results in the imparted slur effect. The volume level of the musical tone is controlled by the envelope waveform signal EV which varies in response to sequential variations in its pitch. This enables persons to listen to the musical tone with the slur effect always at its constant volume level.

On the other hand, the musical tone generated by the staccato playing operation or by the legato playing operation when the slur switch S.SW is turned off, will correspond in pitch to the depressed-key's tone, because the frequency information F' issued from the slur control unit 5 does not change or vary with respect to time at all. That is, the generated tone is an ordinary musical tone without the slur effect. And if the time interval between the key depressing operations is short, then the musical tone of the previous depressed key will be abruptly decayed in volume and subsequently the musical tone of a newly depressed key will start with its attach portion. As a result, a nutural playing tone can be obtained. In addition, since the volume level of the musical tone is controlled according to the pitch of the depressed key, the listeners can listen to the musical ones always at a constant volume level.

Figure 9:
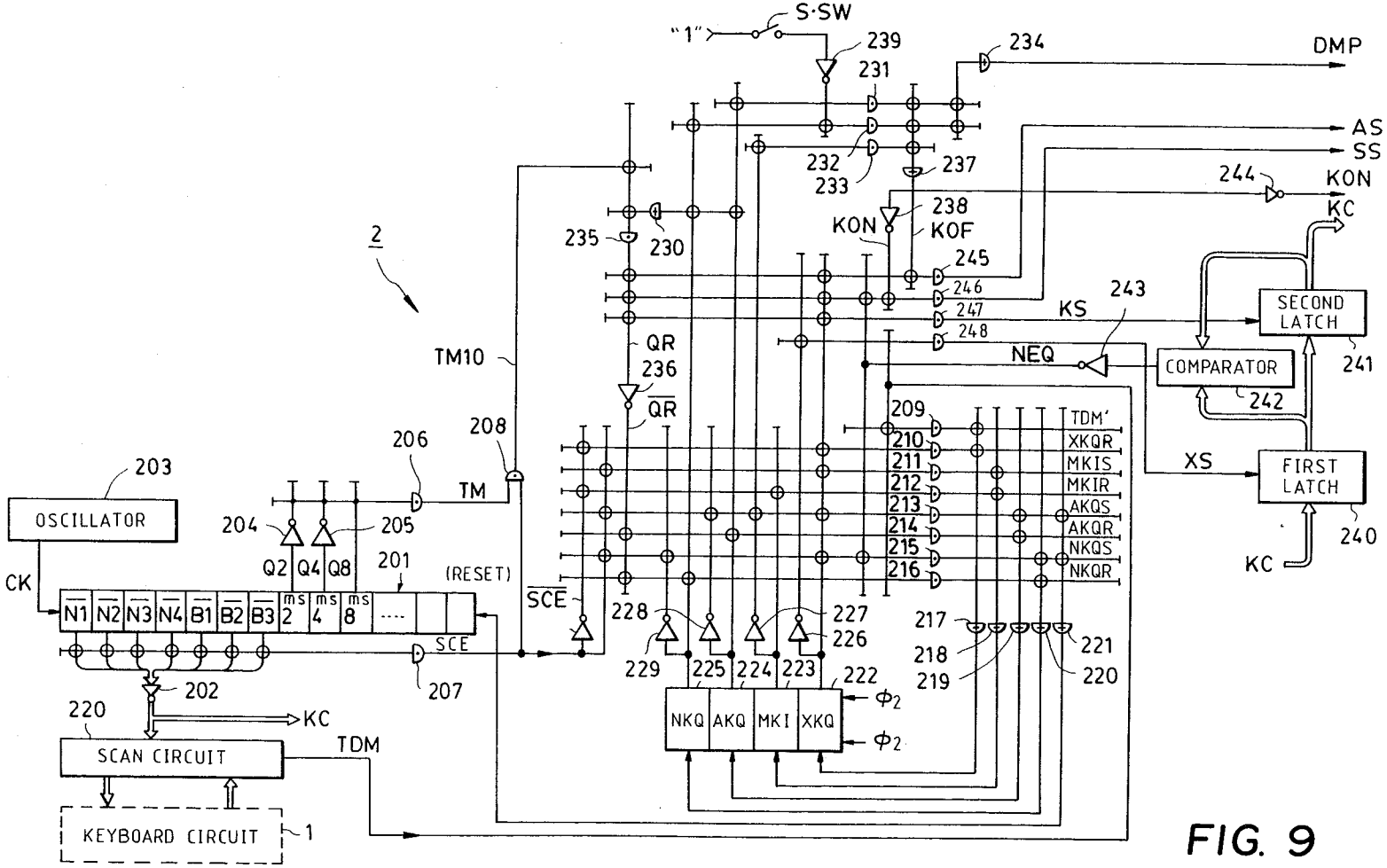
FIG. 9 is a particular block diagram of a depressed key detrection circuit used in the embodiment of FIG. 1.

Next, there is shown in FIG. 9 a block diagram of an arrangement of the depressed-key detecting circuit 2 according to an embodiment of the present invention. In FIG. 9, a scan circuit 200 detects the operations of key switches in the keyboard circuit 1. More specifically, an inverter 202 receives count output signals N1 to B3 from the lower 7 bits of an M-al notation counter 201 and inverts them to signals N1 to B3. The scan circuit 200 receives the inverted signals N1 to B3. The scan circuit 200 receives the inverted signals N1 to B3 from the inverter 202, and sequentially scan the keyboard key switches from the higher tone side to the lower tone side. If the scanner 200 finds a key switch in operation through its sequential scanning operation of the key switches, then the scanner will generate a detection signal TDM of a pulse width "1" corresponding to the scanning period of time at the time of scanning the operating key switch. In other words, the scan circuit 200 will generate the depressed-key detection signal TDM of "1" at the time of scanning an operating key switch and will generate the signal TDM of "0" at the time of scanning a not operating key switch, Under this condition, after initialized by a reset signal, the M-al notation counter 201 will increment its count value, starting with the all "0" of the count output signals N1 to B3. On the other hand, the scan circuit 200 will receive the signals N1 to B3 to which the inverter 202 inverts the count output signals N1 to B3, and will scan the key switches from higher tone side to lower tone side as has been mentioned.

As a result, if the bits of the signals N1 to B3 have all "1" (that is, if the counter 201 is "0" in its count value), the highest tone key switch will be scanned. Hereinafter, as the values of the signals N1 to B3 decrease (as the count values of the counter 201 increase) the lower tone side key switches will be sequentially scanned. The signal N1 to B3 supplied into the scan circuit 200 are used as a key code KC indicative of a key corresponding to the current-scanning key switch during each scanning operation. The key code KC (N1 to B3) has a larger value for higher tone keys and corresponds to the pitch of the keys.

Now, the M-al notaion counter 201 will count a clock signal CK having a period of 16 us supplied from an oscillator 203. Therefore, the count value of the M-al notation counter 201 will vary sequentially for every 16 μs time. This results in the fact that one key switch has a scanning period of 16 μs and that one scanning cycle for all the key swithes is about 2 ms ($16\ \mu s \times 2^7$). The lower 7 bits (N1 to B3) in the M-al notation counter 201 are used for key switch scanning operation, a has been explained above, but may be used as a timer which controls the generation period or duration (10 ms) of the decay instruction signal DMP. More particularly, count output signals Q2, Q4 and Q8 of 3 bits of the countrr 201 higher than the bit B3 will become "1" respectively 2 ms, 4 ms and 8 ms after the counter 201 is initialized by the reset signal. The counter output signals Q2 and Q4 are sent to respective inverters 204 and 205 which in turn supply the inverted signals Q2 and Q4 to an AND gate 206. On the other hand, the count output singal Q8 is supplied directly to the AND gate 206. This causes an output signal TM of the AND gate 206 to have a valve of "1" 8 ms after the M-al notation counter 201 has been reset. If the count output signals N1 to B3 are applied to an AND gate 207, then the AND gate 207 will generate an output signal SCE of "1" 2 ms after the M-al notation counter 201 has been reset. As a result, when the output signal TM of the AND gate 206 and the output signal SCE of the AND gate 207 are supplied to an AND gate 208, the AND gate will generate a timer signal TM10 of "1" ms after the M-al notation counter 201 has been reset.

In this connection, the establishement of the input conditions for the AND gate 207 means that the key switch scanning operation has been completed one cycle. Thus, the output signal SCE from the AND gate 207 is used a a scan end signal. The scan end signal SCE and the timer signal TM10 issued from the AND gate 208 have each a pulse width of 16 μs.

Now, the operation of the electronic musical instrument according to the present invention will be described in the case where the staccato playing operation is performed on the keyboard.

First, the depressed-key detection signal TDM indicative of the state of keys is sent from the scan circuit 200 via an AND gate an OR gate 217 to a flip-flop 222. The flip-flop 222 functions to temporarily store the presence of an operating key switch (that is, a depressed key) during the current key-switch scanning cycle.

More specifically, when receiving the depressed-key detection signal TDM of "1" from the OR gate 217 in response to the generation of a clock pulse $\phi_1$ during scanning of the operating key switch, the flip-flop 222 will generate a detection signal XKQ indicative of the presence of the depressed key in response to the generation of a clock pulse $\phi_2$. The detection signal XKQ is applied to an AND gate 210. The gate 210 also receives a signal SCE to which the scan signal SCE is inverted by an inverter 226. Accordingly, if the scan end signal SCE is not generated, then the AND gate 210 will generate an output signal XKQR of "1". The output signal XKQR is applied to the OR gate 217, together with an output signal EDM' from the AND gate 209. This results in the fact that the flip-flop 222 will maintain its input signal at "1" level under influence of the output signal XKQR of the AND gate 210, even if the detection signal TDM of a level "1" and a pulse width "16 μs" disappears.

When the key switch scanning operation has been completed fully one cycle and the scan end signal SCE has a level of "0", on the other hand, the output signal XKQR of the AND gate 210 will also has a level "0". This causes the flip-flop 222 to be reset each time the scan end signal SCE is generated. In this connection, the flip-flop 222 is set when the depressed-key detection signal TDM has a level "1" for the first time. In other words, when the operating highest-tone one out of a plurality of key switches is scanned, the flip-flop 222 is set. Therefore, the flip-flop 222 will generate the signal XKQ indicative of the presence of an operating key switch during the duration from the scanning operation of the highest-tone operating key switch to the generation of the scan end signal SCE.

Figure 10:
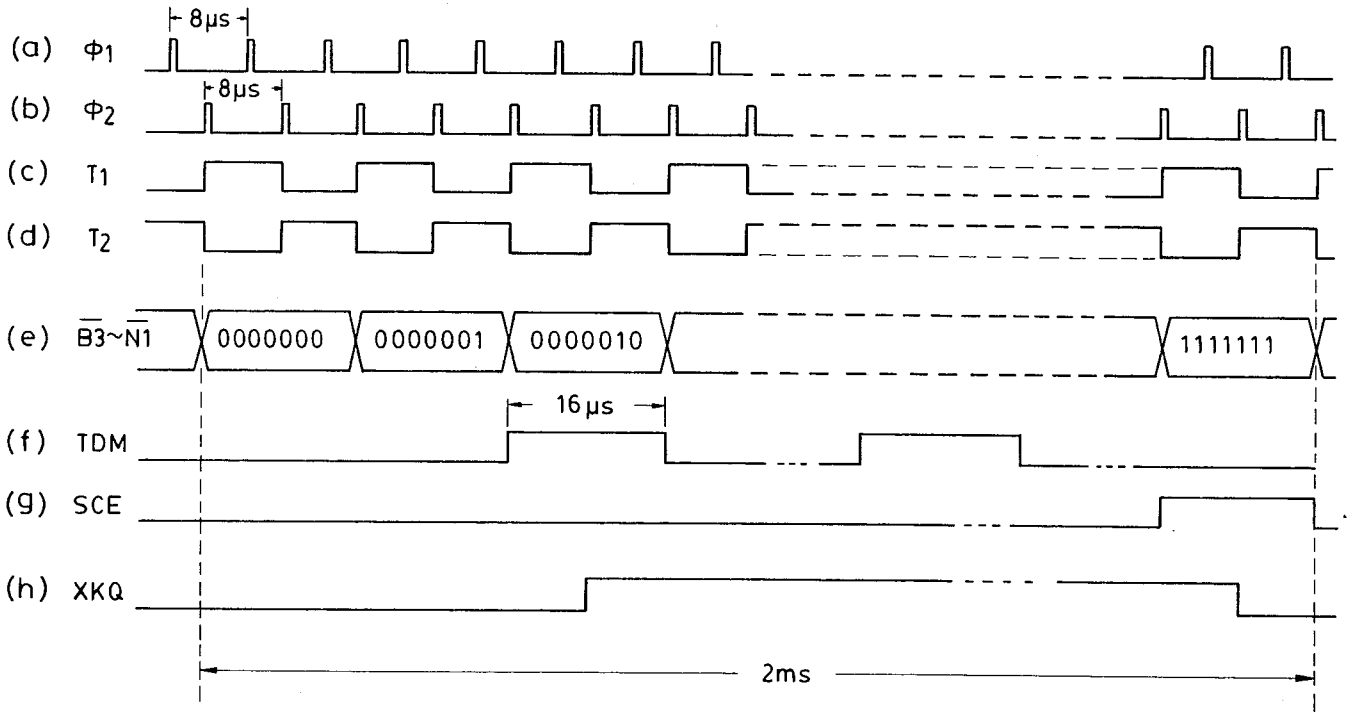
FIG. 10 is a timing chart for explaining the operation of the circuit of FIG. 9.

FIG. 10 is a timing chart showing the count output signals B3 to N1 (see (e) in the figure) from the counter 201, the depressed-key detection signal TDM see (f)), the scan end signal SCE(see(g)), the detection signal XKQ(see(h)) indicative of the presence of a depressed key, the clock pulses (see(a) and (b)), the timing pulse $T_1$(see (c)), and the timing pulse $T_2$(see(d)), used until the flip-flop 222 is set through the key-switch scanning operation. The clock signal CK for driving the counter 201 is the same as the timing pulse $T_1$ and thus is not illustrated in FIG. 10.

The depressed-key detection signal TDM is also applied to an AND gate 248. The gate 248 further receives at its another input signal XKQ to which the output signal XKQ of the flip-flop 222 is inverted by an inverter 226. Under this condition, if the flip-flop 222 is reset and the scan circut 200 generates the depressed-key detection signal TDM of "1", then the AND gate 248 will produce an output signal XS of "1". That is, the AND gate 248 will generate the signal XS of level "1" in synchronism with the scanning timing when the detection signal TDM has a level "1" for the first time. The signal XS is applied as a latch control signal from the AND gate 248 to a first latch circuit 240. This results in that the key code KC corresponding to the first-detected operating key switch during each key switch scanning cycle, i.e., the key corresponding to the highest-tone one of the depressed keys is put in its latch mode. In this connection, the latch control signal XS has a pulse width corresponding to the time duration from the first switching of the depressed-key detection signal TDM to the "1" level to the switching of the output signal XKQ of the flip flop 222 to the "1" level. Since the AND gate 248 is disabled or closed when the output signal XKQ of the flip-flop 222 has a level "1", the gate 248-will generate the latch control signal XS once during each scanning cycle.

In this way, the first latch 240 will generate the key code KC corresponding to the highest tone one of the depressed keys.

On the other hands, an AND gate 211 receives at one input the output signal XKQ from the flip-flop 222 and at the other input the scan end signal SCE. Thus, as long as the flip-flop 222 is set (XKQ | "1"), the AND gate 211 will produce an output signal MKIS of a level "1" when receiving the scan end signal SCE. The signal MKIS is supplied via an OR gate 218 to a flip-flop 223.

The flip-flop 223 is provided to store the fact that the operating key switch has existed during the previous key-switch scanning operation. The flip-flop 223 is activated or driven by the clock pulses $\phi_1$ and $\phi_2$ and set by the output signal of "1" from the OR gate 218, in the similar way to the flip-flop 222 mentioned above. The AND gate 212 will receive at one input an output signal MK1 from the flip-flop 223 and at the other input the signal SCE to which the scan end signal SCE is inverted by the inverter 226, and will generate an output signal MKIR to send it via the OR gate 218 to an input of the flip-flop 223. As a result, when the flip-flop 223 has been set once and subsequently a new scan end signal SCE is generated, the output signal MKIR of the AND gate 212 has a level of "0". This causes the flip-flop 223 to be reset at the time of a generation of the scan end signal SCE. Since continuous presence of the operating key switch during the duration from the previous scanning cycle to the current scanning cycle will cause continuous setting of the flip-flop 222, the output signal MKIS of the AND gate 211 will again has a level of "1". This will not cause the flip-flop 223 to be reset.

Therefore, the key operation state where when the flip-flop 223 is reset the flip-flop 222 is set, will correspond to the staccato playing state where after the first key is released the next new key (the second key) is operated.

The output signal MK1 from the flip-flop 223 is inverted by an inverter 227 to apply it to one input of an AND gate 213. The gate 213 also receives at the other inputs the scan end signal SCE and a signal AKQ to which an output signal AKQ of a flip-flop 224*a* is inverted by an inverter 228. Under this condition, with the flip-flop 224*d* in the reset mode, if the flip-flop 223 is set and the scan end signal SCE is generated, then the AND gate 213 will produce a signal AKQS of a level "1" which in turn is sent to an input of the flip-flop 224 via an OR gate 219.

The flip-flop 224 generates the any new key-on signal AKQ indicative of the fact that a new key depression has occurred after the absence of key depressing operation. Like the flip-flops 222 and 223 explained in the foregoing, the flip-flop 224 is activated by the clock pulses $\phi_1$ and $\phi_2$ and is reset as soon as the output signal AKQS of the AND gate 213 is switched to the "1" level. With the absence of any depressed key operation during the previous scanning cycle and the flip-flop 223 in the reset mode (MK1 = "0"), a setting of the flip-flop 222 by a new depressed-key operation (XKQ = "1") will cause the flip-flop 224 to be set upon generation of the scan end signal SCE during the scaning cycle for detecting the new depressed-key operation.

The any new key-on signal AKQ is fed from the flip-flop 224 via an AND gate 214 which receives the signal QR and via the OR gate 219 back to the input of the flip-flop 224, whreby the signal AKQ is kept at the "1" state until the signal QR is switched to the "0" state. The signal AKQ is also sent to an AND gate 231 and further to an OR gate 234 to generate the decay instruction signal DMP mentioned above.

On the other hand, the output signal AKQS is supplied from the AND gate 213 via an OR gate 221 to the M-al notation counter 201 as a reset signal for the counter 201. When the counter 201 is rest by the reset signal, the counter will start its counting operation for key switch scanning and at the same time, act a a timer for control of the generation period or duration of the decay instruction signal DMP.

Ten milli-seconds after setting of the M-al notation counter 201 by the output signal AKQS from the AND gate 213, the AND gate 208 will generate the timer signal TM10, as has been explained earlier.

The timer signal TM10 is applied to an AND gate 235. The gate 235 also receives the any new key-on signal AKQ sent from an OR gate 230 via the flip-flop 224.

Therefore, when the counter 201 is reset and a time 10 ms elapses, the AND gate 235 will generate the output signal QR of level "1". The signal QR is supplied from the AND gate 235 to AND gates 245, 246 and 247. The AND gate 245 also receives a the other inputs the output signal XKQ from the flip-flop 222 and a key off signal KOF from an OR gate 237.

The gate 237 is turn functions to perform a logical sum of output signals from AND gates 231, 232 and 233, and produce the key off signal. In this case, since the flip-flop 224 is set and correspondingly the output signal of the AND gate 231 is at the "1" level, the key off signal KOF is also at the "1" level.

On the other hand, the AND gate 247 receives the output signal QR of the AND gate 235 is at the "1" level and the flip-flop 222 is set (that is, if a new key is depressed continuously), then the AND gates 245 and 247 wi11 produce respectively an attack start signal AS and a latch control signal KS in synchronism with the generation of the signal QR.

The latch control signal KS is supplied from the AND gate 247 to a second latch circuit 241. The second latch 241 also receives the output signal (key code KC) from the first latch 240. This causes the key code KC of the highest-tone depressed key previously latched at the first latch 240 to be transferred to the second latch 241 and further to the frequency information memory 3 and the envelope generator 4. In other words, when a new key is depressed after the absence of any depressed key, the key code KC corresponding to the new depressd key will be sent 10 ms after generation of the decay instruction signal DMP.

On the other hand, the output signal QR of the AND gate 235 is inverted by an inverter 236 and supplied to the AND gate 214. The AND gate 214 also receives at its other input the output signal AKQ from the flip-flop 224 and generates an output signal AKQR. The signal AKQR is supplied via the OR gate 219 to the flip-flop 224 and thus 10 ms after setting of the flip-flop 224, the AND gate 214 will produce the output signal of a level "0", causing resetting the flip-flop 224. This results in the fact that the output signal of the AND gate 231 has a level of "0" and the decay instruction signal DMP from the OR gate 234 has a level of "0". Further, when the flip-flop 224 is reset and the OR gate 231 produces the output signal of a level "0", the OR gate 237 will also generate the key off signal of level "0". The key off signal KOF is sent to an inverter 244 to invert it and generate a key on signal KON.

The operation of the musical instrument or system according to the invention in the staccat playing mode will be summarized as follows.

When a new key is depressed after the absence of any depressed key, first, the key code corresponding to the new depressed key (if a plurality of keys are simultaneously depressed, the highest tone one of the plural depressed keys) is latched at the first latch circuit 240. Subsequently, the flip-flop 224 is set to generate the any new key-on signal AKQ of level "1", causing the decay instruction signal DMP of level "1". At the same time, the counter 201 is reset to start measuring the generation time of the signal DMP. Ten milli-seconds later, the latch control signal KS is generated so as to transfer to the second latch 241 the key code KC of the new depressed key (or the highest tone depressed key) previously latched at the first latch 240, generating the attach start signal AS.

After this, the flip-flop 224 is reset to stop sending the decay instruction signal DMP and to generate the key-on signal KON.

This results in that the envelope generator 4 will decay or attenuate the old envelope waveform signal EV corresponding to a key already released and 10 ms after the attenuation, will generate a new envelope waveform signal EV corresponding to a new depressed key, starting with the attack portion AT.

In this connection, the generation of a musical tone by the new depressed key starts after the termination of the decay instruction signal DMP, and for this reason the musical tone generation will be delayed 10 ms. However, this delay will not cause any trouble in practical applications.

Next, explanation will be directed to the case where the slur switch S.SW is turned on and the electronic musical instrument is in the legato playing mode.

In the legato playing operation or mode, when the first key is depressed first after the absence of any depressed key; the decay instruction signal DMP, attack start signal AS, key-on signal KON and key code KC will be issued, as in the staccato playing mode. If the second key higher in pitch than the first key is depressed before the first key is released, then the scan circuit 200 will generate the depressed key detection signal TDM of level "1" when the first and second keys are scanned, respectively. Since the second key is higher in pitch than the first key, however, the detection signal TDM of the second key is generated prior to the detection signal TDM of the first key.

This results in that the flip-flop 222 (which as been set by the first key detection signal TDM (of level "1") until the second key is depressed) will be reset by the second key detection signal TDM (of a level "1") generated by a depression of the second key. At the same time, the AND gate will generate the latch control signal XS and send it to the first latch circuit 240 which thereby latches the key code KC of the second key (higher in pitch than the first key).

At this point, the key code KC of the first key is already latched in the first latch 241. A comparator 242 compares the contents stored in the second latch 241 and the contents stored in the first latch 240. As a result, at the time the second key code KC is latched in the first latch 240, the comparator 242 will generate an equality detection signal EQ and supply it to an inverter 243. This also will cause the inverter 243 to generate an unequality detection signal NEQ of level "1" indicating that the second latch 241 is different in the stored contents from the firtst latch 240.

The unequality detecting signal NEQ is sent to an AND gate 215 an issued as one of the signals required to set a flip-flop 225. The AND gate 215 also receives at its other inputs the output signal XKQ from the flip-flop 222, the signal NKQ to which an output signal NKQ of the flip-flop 225 is inveter by an inverter 229, and the scan end signal SCE from the AND gate 207.

Since the flip-flop 222 is set by the detection signal TDM of the second key as described above, the output signal XKQ of the flip-flop 222 has a level of "1". Further, the flip-flop 225 in the reset state at this time will generate the signal NKQ of level "1". Therefore, as soon as the unequality detection signal NEQ is switched to the "1" level, the AND gate 215 will generate a signal NKQS of level "1" in synchronism with the scan end signal SCE generated at the end of the scanning cycle. The signal NKQS is applied via an OR gate 220 to the flip-flop 225 to set the flip-flop 225.

In this way, when the first key is depressed and then the second key (higher in pitch than the first key) is depressed, the flip-flop 225 will be set. The output signal NKQ of the flip-flop 225 is used as a new key code detection signal indicating that a new key has been depressed. To this end, the output signal NKQ of the flip-flop 225 is fed via an AND gate 216 having the input signal QR and the OR gate 220 back to the input of the flip-flop 225 to thereby maintain the flip-flop 225 at the set state. The output signal NKQ is also applied to the OR gate 230 and the AND gate 232.

The output of the AND gate 232 will be sent to the OR gate 234 to produce the decay instruction signal DMP and also sent to the OR gate 237 to produce the key-off signal KOF. At this time, however, the AND gate 232 further receives at another input a signal to which an ON signal (of level "1") from the slur switch S.SW is inverted by an inverter 239, enabling or opening the AND gate 232. For this reason, an application of the new key code detection signal NKQ of "1" to the AND gate 232 will cause no generation of the decay instruction signal DMP of level "1". Also, the key off signal KOF does not have a level "1" and the key on signal KON from the inverter 244 is kept at a level "1" continuously following the first key depression.

On the other hand, the output signal NKQS is supplied as a reset signal from the AND gate 215 via the OR gate 221 to the counter 201, thereby resetting the counter 201.

When the counter 201 is reset and a time 10 ms elapses, the AND gate 208 will generate the timer signal TM10 and supply it to the AND gate 235, as mentioned before. The AND gate 235 also receives at the other input the new code detection signal NKQ (of a level "1") from the OR gate 230, and thus 10 ms after the generation of the output signal NKQS from the AND gate 215 the AND gate 235 will generate the signal QR of level "1". The signal QR is applied from the gate 235 to the AND gates 245, 246 and 247 and also to the AND gate 216 via the inverter 236.

Since the input key off signal KOF of the AND gate 245 has a level of "0" as described before, the AND gate 245 will not generate the attack start signal AS even if receiving the signal QR (of level "1").

On the other hand, the AND gate 246 receives the key-on signal KON from the inverter 238, the unequality detection signal NEQ from the inverter 243 and the output signal XKQ from the flip-flop 222, these input signals to the AND gate 246 having all a level of "1". Therefore, as soon as the signal QR is switched to the "1" level, the AND gate 246 will be satisfied with its logical AND conditions or opened and thus will generate a slur start signal SS. In other words, when a new aditional key is depressed in the legato playing mode, the slur start signal SS will be generated in place of the attack signal AS.

Further, the AND gate 247 is satisfied with its logical AND conditions at generation of the signal QR, because the flip-flop 222 has the output signal XKQ of level "1", which results in a generation of the latch control signal KS from the AND gate 247. This will cause the second key code KC so far stored in the first latch 240 to be moved into the second latch 241. The second key code KC is further supplied from the second latch 241 to the frequency information memory 3 and the envelope generator 4. At this time, the first latch 240 has the same contents as the second latch 241, and thus the comparator 242 generates the equality detection signal EQ of level "1" and the inverter 243 generates the unequality detection signal NEQ of level "0".

The AND gate 216, on the other hand, receives the new key code detection signal NKQ from the flip-flop 225. For this reason, switching of the signal QR to the "1" level will cause the output signal MKQR of the AND gate 216 to be switched to the "0" level. The output signal NKQR of the AND gate 216 is applied to the OR gate 220. Since the OR gate 220 also receives at its other input the output signal NKQS from the AND gate 215, the gate 220 will generate a signal of level "0" and rest the flip-flop 225 which has been set to cause the output signal NKQ of the inverter 229 to have a level of "0".

Now, the flip-flop 223 is set because of the presence of the depressed key (the first key) in the previous scanning cycle and thus the flip-flop 223 generates the output signal MK1 of level "1". Therefore, since the AND gate 213 receives the signal MK1 to which the signal MK1 is inverted by the inverter 227, the gate 217 will be disabled or closed and the flip-flop 224 will not be set. In other words, even if the first key is depressed and the second key is newly depressed, the flip-flop 224 will not be set and the any new key-on signal KON will not be generated.

The electronic musical instrument of the invention will operate as follows when the slur switch S.SW is tuned on and the musical instrument is in the legato playing mode.

As soon as the first key is depressed and the second key is newly depressed, the flip-flops 222 and 225 will be set and the M-a1 notation counter 201 will be reset, starting measurement of a time duration 10 ms. After 10 ms, the slur start signal SS is issued an the key code KC corresponding to the newly-depressed second key is generated. At this time, the key-on signal KON will maintain its level at "1" continuously during the duration from a depression of the first key to a release of the second key.

The flip-flop 225 is set and reset simultaneously with the flip-flop 224, even in the staccato playing mode. However, the flip-flop 225 will not cause effective operation in this mode.

Next, explanation will be made in the case where the slur switch S.SW is turned off and the instrument of the invention is in the legato playing mode.

The operation of the instrument in this case is similar to in the above staccato playing mode. More specifically, when the slur switch S.SW is turned off, the signal supplied from the inverter 239 to the AND gate 232 has a level "1". This causes the flip-flop 225 to be set to generate the new key code detection signal NKQ (of level "1"), thereby providing a "1" state for the output signal of the AND gate 232. As a result, the OR gate 234 will generate the decay instruction signal DMP of level "1". The key-off signal KOF issued from the OR gate 237 will also have a level of "1" and the key-on signal KON issued from the inverters 238 and 244 will have each a level of "0". Therefore, even if the new key code detectionsignal NKQ is generated and a time 10 ms elapses and the AND gate 235 generates the signal QR of level "1", the AND gate 246 will not be satisfied with its AND conditions and thus will not generate the slur start signal SS. On the contrary, if the AND gate 245 is satisfied with its AND conditions to generate the attack start signal AS, then the musical tone similar to in the staccato playing mode can be generated or emitted.

The OR gate 237 will receive an output signal of the AND gate 233 wich in turn receives the signal MK1 inverted by the inverter 227 from the output signal MK1 of the flip-flop 223, and in the absence of any depressed key after the previous scanning cycle, will generate the key-off signal KOF of level "1".

Attention will next be directed to the detailed arrangement of the envelope generator 4.

Figure 11:
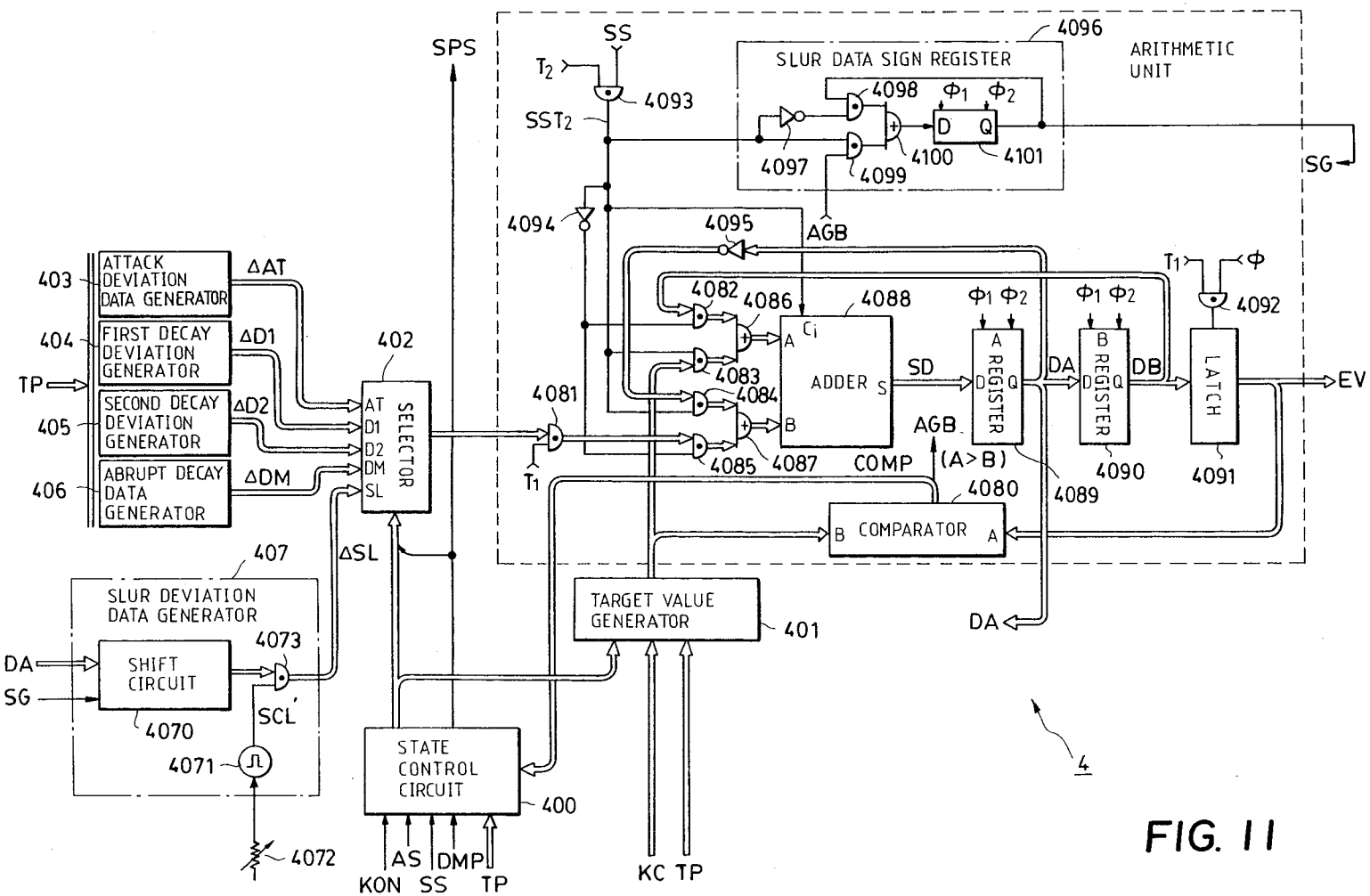
FIG. 11 is a particular block diagram of an envelope generator used in the embodiment.

FIG. 11 shows a block diagram of an embodiment of the envelope generator 4 in accordance with the present invention. In the figure, a state control circuit 400 receives the key-on signal KON, the attack start signal AS, the slur start signal SS, the decay instruction signal DMP, and the tone-color parameter information TP. It also receives an information COMP indicative of the compare result between the current value and target value of the envelope waveform signal EV.

The state controller 400 generates a state signal STn(n=0, 1, 2 or 3) for formation of the segments or portions of the envelope waveform signal EV including the attack portion AT, first decay portion D1, sustained portion ST and second decay portion D2, on the basis of its input signals and information. Further, when receiving the slur state signal SS, the controller 400 will generate a slur pitch start signal SPS for sequentially varying the generating envelope waveform signal EV and for sequentially varying from the pitch of the first key toward that of the second key the pitch of the musical tone generated in synchronism with the sequential variation of the envelope signal EV until the generating signal EV conforms to the envelope waveform signal EV of the second key, For the brevity of the explanation, the varying state of the state signal STn for generation of the envelope waveform signal EV will be explained with reference to the flow chart of FIG. 12 and the waveforms of FIGS. 2 to 7.

Figure 12:
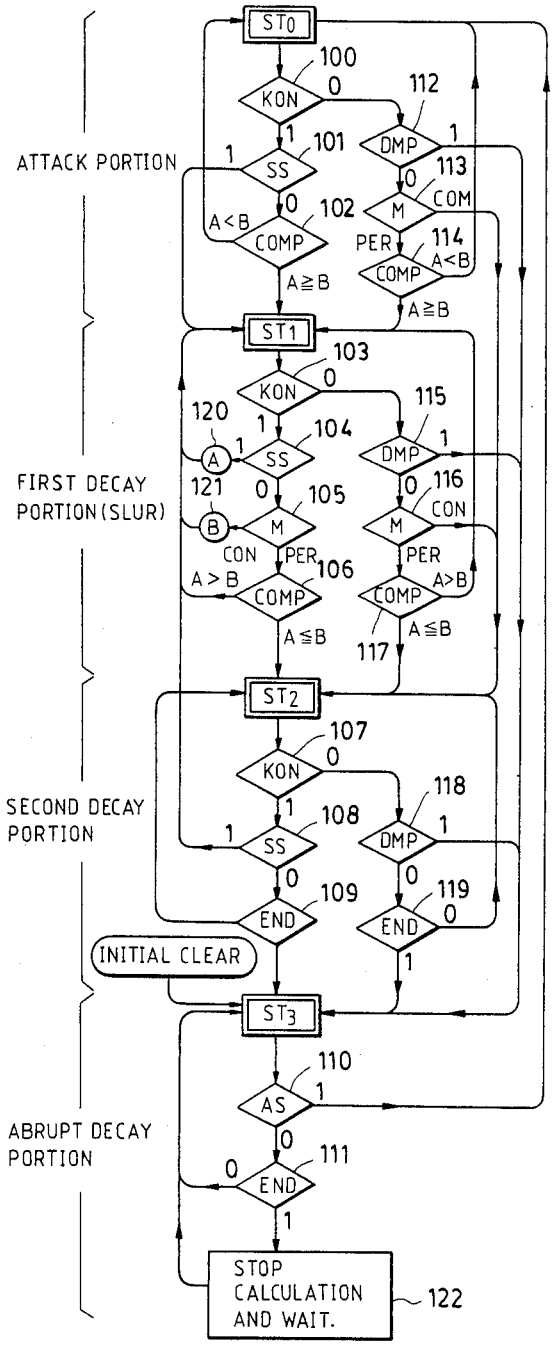
FIGS. 12 and 13 are flowcharts for explaining the operation of the circuit of FIG. 11.

In FIG. 12, after the power source is turned on and an initial clear signal (not shown) is generated the system will be put in its $ST_3$ state. Under this condition, when the first key for the staccato or legato playing operation is depressed and an abrupt decay period of 10 ms elapses, the attack start signal AS is generated for generating the attack portion At in the envelope waveform signal EV of the first key. This causes the system to be switched to its $ST_0$ state at an AS decision step 110.

In the $ST_0$ state, if the key-on signal KON has a level of "1" and the slur start signal SS is not generated, then control moves from the step 110 via a KON decision step 100 to an SS decision step 101. At the step 102, a comparison is made between the current value A and target value B (attack level) of the signal EV to decide whether $A \geqq B$ or $A < B$. If the comparison result information COMP is $A < B$ or $EV < TL$, then control repeates in a loop of the steps $ST_0$, 100, 102 and $ST_0$, uring which a deviation data AT of the attack portion AT is added sequentially or incrementally to the current value A of the signal EV. As a result, the current value A of the signal EV increases sequentially. As soon as the current value A of the signal EV reaches the target value B (that is, as soon as A is greater than or equal to B), the system will be switched to the $ST_1$ state at the step 102. That is, as soon as the attack portion At has been formed, the system will be switched to the state $ST_1$ for the first decay portion D1.

When the key-on signal KON and the slur start signal SS are not generated in the $ST_1$ state, control will proceed to a step 105 via decision steps 103 and 104. At the atep 105, it is determined whether the envelope mode M is of a continuous tone(CON) or of a percussive tone(PER). If the mode M is of the percussive tone(PER), then control goes to the next step 106 to compare the current value A and target value B (the first decay level 1DL) of the signal EV. When the comparison result information COMP is $A > B$ or the current value A of the signal EV does not reach the first decay level 1DL, the operation is repeated in a loop from the step 104 to the step 106, during which a deviation data D1 (negative value) of the first decay portion D1 is added sequentially to the current value A of the signal EV. As a result of the addition, when the current value A of the signal EV becomes equal to or less than the target value $B(=1DL)(A \leqq B)$, the system will be switched to a state $ST_2$ for the second decay portion D2 at the decision step 106. In other words, as soon as the first decay portion D1 in the percussive envelope waveform signal EV has been formed, the system will be switched from the state $ST_1$ to the state $ST_2$.

Figure 13:
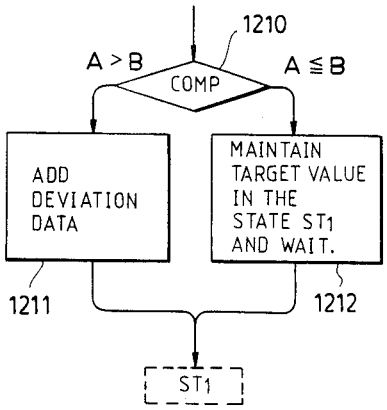

On the other hand, if it is decided at the step 105 that the mode M is set to be continuous tone(CON), then control goes to a step 121. At the step 121, the current value A of the envelope waveform signal EV is compared with the target value B(=the first decay level 1DL) for the first decay portion D1 refer to a step 1210 in FIG. 13).

When the comparison result information COMP is $A > B$ or the current value A of the signal EV does not arrive at the first decay level 1DL, the deviation data D1 (negative value) of the first decay portion D1 is added to the current value A at the next step 1211. As a result of the addition, if the current value A of the signal EV becomes equal to or less than the target value B, then control proceeds from the step 1210 to a step 1212 to maintain the current value A (that is, the first decay level 1DL) during the state SM1 period of time until the key is released.

With this standby condition, a release of the key causes control to be transferred from the step 103 to a step 115, since the key-on signal KON has a level of "0". At the step 115, it is decided whether or not the decay innstruction signal DMP is generated. If the signal DMP os not generated, then control goes to the next step 116 to decide whether the mode M is of the continuous tone(CON) or of the percussive tone(PER). Now, since the mode M is of the continuous tone(CON), the system will be switched to the state $ST_2$ for the second decay portion D2 at the decision step 116. That is, in the continuous tone mode, after the current value A of the envelope waveform signal EV arrives a the first decay level 1DL, the key-on signal KON is switched to its "1" level and the system is changed to the state $ST_2$.

With the state $ST_2$, first, it is decided at a step 107 whether the key-on signal KON has a level of "0" or "1". If the key-on signal KON is at the "0" level, then control proceeds from the step 107 to a step 118. At this point, when the decay instruction signal DMP is not generated, control goes from the step 118 to a step 119 where it is decided whether or not the current value A of the signal EV reaches the target value B of the second decay portion D2 (i.e., the initial level IL), that is, whether or not the signal EV has been decayed. If the signal EV has not been decayed, then the operation is repeated in a loop of the steps 107, 118, 119, $ST_2$ and 107, during which a deviation data D2 of the second decay portion D2 is added sequentially to the current value A of the signal EV. After the addition results in the fact that the signal EV reaches the initial level IL to terminate the decay portion in the signal EV, the system is changed to a state $ST_3$. At the step 110, it is decided whether or not the attack start signal AS is generated. Since the attack signal AS is not generated until the next key is newly depressed, control moves to the next key is newly depressed, control moves to the next step 111 from the step 110. If the signal EV has been already decayed at the step 111 from the step 110. If the signal EV has been already decayed at the step 111, then control goes to a step 122 to stop the calculation on formation of the signal EV and put the signal EV in the standby mode.

The above explanation about state transitions in the envelope signal has been made in the case where the time interval between key depressing operations is long enough. In the event where the second key is newly depressed before the envelope waveform signal EV of the first depressed key has not been decayed completely, the electronic musical instrument according to the present invention will operate as follows.

While the attack portion At in the signal EV of the first key is formed during the repetitive operation of the steps 100, 101, 102 and 100, a new depression of the second key following the release of the first key, for example, will cause a generation of the decay instruction signal DMP. During the generation of the decay instruction signal DMP. During the generation of the signal DMP, the key-on signal KON is forced to have a level of "0". For this reason, control proceeds from the step 100 to a step 112 in the course of the above cyclical operation of the steps 100, 101, 102 and 100. At the step 112, the system is changed to a state $ST_3$ and it is decided whether or not the attack start signal AS is generated in the state $ST_3$.

Since the attack start signal AS is generated following the generation of the decay istruction signal DMP, control goes from the step 112 to the step 110 and further to the step 111. It is decided at the step 111 whether or not the current value A of the signal EV reaches the initial level IL of the target value for the abrupt decay portion DM.

Since the current value A is greater than the initial level IL at the early stage, the operation is repeated in a loop of the steps 111, 110 and 111. In the courser of the repetitive operation, the signal EV is abruptly decayed and thus a deviation data DM(negative value) is added sequentialy to the current value A. As a result of the addition, if the value A is less than or equal to the initial level IL, then control proceeds from the step 111 to the step 112 and to stop the calculation about formation of the signal EV, putting the system in the standby mode.

Next, while the first decay portion D1 in the envelope waveform signal EV is formed by the repetitive operation of the steps (103, 104, 105, 121, 103), (103, 104, 105, 106, 103, 104, 105, 106), or (1034, 115, 116, 117, 103), the decay instruction signal DMP becomes "1" in its level. As soon as the key-on signal KON is switched to the "0" level, control goes from the step 103 via the step 115 to the step $ST_3$ in the course of the above repetitive operation, so that the current value A of the signal EV is abruptly decayed in the state $ST_3$, in the similar manner to the above.

While the second decay portion D2 in the envelope waveform signal EV is formed by the repetitive operation of the steps (107, 108, 109, 107), the decay instruction signal DMP is switched to the level "1". When the key-on signal KON is changed to the "0" level, control is transferred in the course of the above repetitive operation from the step 107 via the step 118 to the step $ST_3$. As a result, the current value A of the signal EV is abruptly decated in the state $ST_3$, in the similar way to the above.

This results in the fact that even in any portion of the first key signal EV the decay instruction signal DMP has a level "1", and that as soon as the key-on signal KON is switched to the "0" level the control moves to the $ST_3$ step to decay abruptly the current value A. And, as soon as the system stops the generation of the signal DMP10 ms later and generates the attack start signal AS, the envelope waveform signal EV with respect to the second key is started to form its attack portion AT.

While the attack start portion AT in the envelope waveform signal EV of the first key is formed, if the second key is further depressed and the system generates the slur start signal SS 10 ms following the depression of the second key, then control skips from the step 101 to the step $ST_1$ in the course of the formation of the attack portion AT. The system maintains the key-on signal KON in the state $ST_1$. AS soon as the system generates the slur start signal SS, control proceeds from the step $ST_1$ via the steps 103 and 104 to a step 120. At the step 120, the current value A of the signal EV is compared with the first decay level 1DL' i.e., the target value for the first decay poration D1 of the second key to find a difference signal S(=1DL'−A). Further, a slur deviation data SL (whose value is 1/256·S) in place of the deviation data D1 of the first decay portion D1 is added to the current value A of the signal EV. After the change-over from the deviation data D1 to the slur deviation data SL, the cyclical operation of the steps (103, 104, 120, $ST_1$ and 03) will cause the sequential addition of the slur deviation data SL to the current value A of the signal EV. As a result, as soon a the current value A of the signal EV reaches the first decay level 1DL' of the second key, the system is switched from the $ST_1$ to the state $ST_2$.

That is, the current value A of the attack portion AT in the signal EV changes sequentially (incrementally or decrementally) toward the first deday level 1DL' of the second key. This operation is applied even in the case where the system generates the slur start signal SS during formatiom of the first and second decay portions D1 and D2 in the first key signal EV. When the sytem generates the signal SS during the formation of the second decay portion D2, control skips from the step 108 to the state step $ST_1$ to vary the signal EV.

In this manner, the state signal STn (n=1, 2 or 3) is supplied from the state control circuit 400 to a target value generator 401 to generate the target values TL, 1DL, and IL (see FIG. 2) for the corresponding portions in the envelope signal according to the key code KC and tone-color parameter TP, for example, indicates the contents necessary to form a continuous envelope waveform signal EV and when the generator 401 receives the state signal $ST_0$ and the key code KC, the generator 401 will generate the attack level TL, i.e., the target value of the attack portion AT in the continuous envelope signal EV.

When receiving the state signal $ST_1$, the generator 401 will produce the first decay level signal 1DL corresponding to the target value of the first decay portion 1D.

When receiving the state signal $ST_2$ or $ST_3$, on the other hand, the target value generator 401 will issue the initial level signal IL corresponding to the target value of the second decay portion D2 or abrupt decay portion DM.

In this embodiment, the attack level TL and the first decay level 1DL, in particlular, as portion target values are adjusted so as to decrease as the pitch of a depressed key increases, as in FIG. 8.

The state signal STn and the slur pitch start signal SPS are sent from the state control circuit 400 to a selector 402 to select respective deviations (per unit time) of portions in the envelope waveform signal EV. When receiving the state signal $ST_0$, the selector 402 will select the deviation data AT of the attack portion AT supplied from an attack deviation data generator 403, and will supply it to an arithmetic unit 408 which will be explained later. If receiving the state signal $ST_1$, the selector 402 will select the deviation data D1 of the first decay portion D1 supplied from a first decay-deviation-data generator 404, and will supply it to the arithmetic unit 408. Also, as soon as receiving the state signal $ST_2$, the selector will select the deviation data D2 of the second decay portion D2 fed from a second decay-deviation-data generator 405, and will send it to the arithmetic unit 408. Further, if receiving the state signal $ST_3$, the selector will select the deviation data DM of the abrupt decay portion DM supplied from an abrupt decay data generator 406, and will send it to the unit 408. In addition, when receiving the state signal $ST_1$ and the slur pitch start signal SPS, the selector will select the slur deviation data SL fed from a slur deviation data generator 407, and will apply it ot the unit 408.

The deviation data generators 403 to 406 in turn receive the tone-color parameter TP and generate respectively the deviation data D1, D2 and DM. In this case, the deviation data AT, D1, D2, and DM are expressed in terms of 2's complement.

The arithmetic unit 408 generates an envelope waveform signal corresponding to the key code KC and tone-color parameter TP on the basis of the target values TL, 1DL, IL of corresponding portions issued from the target value generator 401 under control of the state control circuit 400 and selects the deviation data DM for abrupt decay from the abrupt decay data generator 406 to thereby send the data DM to the arithmetic unit 408.

The initial level signal IL is supplied from the target value generator 401 to a compare input (B) of a comparator 4080 and also to an AND gate 4083 in the arithmetic unit 408.

On the other hand, the deviation data DM is fed from the selector 402 to an AND gate 4081 in the unit 408. The AND gate 4083 receives at the other inputs a logical product signal $SST_2$ of the slur start signal SS and the timing pulse $T_2$ (see FIG. 10) from an AND gate 4093. The slur start signal SS is issued from the depressed key detection circuit 2 only when the slur switch S.SW is turned on and the legato playing operation is performed. In the staccato playing mode, the slur start signal SS is a "0" level and thus the AND gate 4093 produces the output signal $SST_2$ of level "0" at all time.

As a result, the AND gate 4083 is not satisfied with its logical AND conditions in the staccato playing mode and therefore is put in the non-conductive state or closed. However, the output signal $SST_2$ from the AND gate 4093 is inverted by an inverter 4094 and sent it to AND gates 4082 and 4085, so that the AND gates 4082 and 4085 are both always put in the conductive state or opened in the staccato playing mode.

Therefore, during the state $ST_3$ period of the staccato playing mode, the AND gate 4081 receives the deviation data DM for abrupt decay and as soon as receiving the timing pulse $T_1$, the gate 4081 supplies the data DM to the AND gate 4085 and an OR gate 4087 and further to an add input (B) of an adder 4088.

On the other hands, the AND gate 4082 receives at the other input an output data DB from a B register 4090.

The B register 4090 in turn receives an output data DA from an A register 4089 in response to the generation of the clock pulse $\phi_1$ and generates the output data DB in response to the generation of the clock pulse $\phi_3$. The output data DB is fed from the B register 4090 to the AND gate 4082 and also to a latch 4091. The latch 4091 in turn receives the data DB and as soon as receiving a logical product signal of the timing pulse $T_1$ and the clock pulse $\phi_1$ from an AND gate 4092, the latch latches the data DB.

The A register 4089 receives an output data SD from the adder 4088 in response to the generation of the clock pulse $\phi_1$ and issues the data DA in response to the generation of the clock pulse $\phi_2$. The output data DA is sent from the A register 4089 to the B register 4090 and also to an inverter 4095. The data DA sent to the inverter 4095 is inverted (that is, converted to its complement value) and the complement of the data DA is applied to an AND gate 4084.

As a result, after passing through the A register 4089 the data SD from the adder 4088 is delayed by the generation period (in this embodiment, 8 us) of the clock pulse $\phi_1$ or $\phi_2$, and after passing through the B register 4090 the data SD is delayed additionally by 8 us. That is, the data SD is issued from the B as the data DB delayed 16 us with respect to the data SD. The output data DB of the B register 4090 is applied to the latch 4091 which latches the data DB of the B register 4090 is applied to the latch 4091 which latches the data DB and produces it in the form of an envelope waveform signal EV. The envelope signal EV is also applied to a compare input (A) of the comparator 4080 as a current value of the signal EV.

Since 4082 and 4085 alone out of the AND gates 4082 to 4085 are put in the conductive state or opened at the time of the staccato playing operation as has been explained above, the data DB is fed from the B register 4090 via the AND gate 4082 and an OR 4086 to an add input(A) of the adder 4088, whereas the deviation data DM for abrupt decay is fed from the selector 402 via the ABD gates 4081 and 4085 and the OR gate 4087 to the add input (B) of the adder.

In this case, the deviation data DM is set to be a negative value. On the other hand, the adder 4088 generates the output data SD of level "0" when the value calculated by the adder is negative.

When the time interval between depressed keys is long enough in the staccato playing operation, the envelope waveform signal EV of the previously-depressed key is waited with the second decay portion D2 already formed, so that the output data DA, DB and EV of the A register 4089, B register 4090 and latch 4091 are each at the initial level IL.

As a result, during the state $ST_3$ period in such a playing mode, the output data SD of the adder 4088 will not change and maintain its initial level IL even if the adder receives the deviation data DM in response to the generation of the timing pulse $T_1$.

In the case where the time interval between depressed keys is short and the envelope waveform signal EV on the already released key is not decayed completely, for example, in the case where the current value of the signal EV is at a level D2Lx in the course of the second decay portion D2 therein and a new key is depressed, the level signal D2Lx is applied as the current value of the signal EV to the add input (A) of the adder 4088. In addition, the adder 4088 receives the deviation data DM at its add input (B) in synchronism with the generation of the timing pulse $T_1$. Therefore, the adder 4088 calculates the following expression.

$$SD=(A)+(B)=D2Lx-DM$$

The calculated output data SD is fed back to the add input (A) of the adder as a new current value of the signal EV ater the signal SD is delayed 16 us through the registers 4089 and 4090 and when the timing pulse $T_1$ is generated again. At this time, the AND gate 4081 is enabled and thus the adder 4088 receives the deviation data DM at its add input (B), executes again the addition of the both input data and sends the addition results as a new output data SD. After this, such an operation is repeated each time the timing pulse $T_1$ is generated.

In this connection, the data generator 406 generates the deviation data DM not always but during the each peroid corresponding to the tone-color indicated by the tone-color parameter TP. The same explanation is applied to the data generators 403, 404 and 405.

In this way, the deviation data DM is not always applied to the add input (B) of the adder 4088 in response to the generation of the timing pulse $T_1$. In other words, the deviation data DM may not be applied to the add input (B) even when the timing pulse $T_1$ is genetated. In such case, the add output data SD is equal to the data DB applied to the add input (A) and thus the current value of the envelope waveform signal EV will not be updated. As a result, the envelope waveform signal EV will be varied (decreased) sequentially by the value of the deviation data DM during each generation period of the data DM.

As soon as the current value A of the envelope waveform signal EV issued from the latch 4092 becomes equal to the initial level IL, i.e., the target value of the state $ST_3$ through the above operation, the comparator 4080 will generate the compare result information COMP indicative of the equality, which puts the state control circuit 400 in the standby condition (refer to steps 111 and 122 in FIG. 12).

When the depressed key detection circuit 2 produces the attack start signal AS concerning a new depressed key 10 ms after the generation of the decay instruction signal DMP, the state control circuit 400 will issue the state signal $ST_0$ (refer to the step 110 in FIG. 12). This causes the target value generator 401 to generate the attack level signal TL indicative of the target value of the attack porion AT. The delector 402 selects the deviation data AT supplied from the attack deviation data generator 403 and supplies it to the AND gate 4081.

This results in the fact that the adder 4088, in response to the generation of the timing pulse $T_1$, receives at the add input (A) the initial level signal IL indicative of the current value of the envelope wave form signal EV from the target value generator 401 via the AND gate 4082 and the OR gate 4086, whereas the adder 4088 receives at the other add input (B) the deviation data AT (positive value) from the selector 402 via the AND gates 4081 and 4085 and the OR gate 4087. Accordingly, the adder 4088 calculates the following expression in response to the generation of the timing pulse $T_1$.

$$SD=(A)+(B)=IL+AT$$

After the output data SD calculated at the adder 4088 is delayed 16 us through the A register 4089 and the B register 4090, the data SD is fed back to the add input (A) of the adder 4088 in synchronism with the generation of the next timing pulse $T_1$.

At this stage, the adder 4088 receives at the add input (B) the deivation data AT and thus calculated the addition of the both data at the inputs (A) and (B). Thereafter, such an operation is repeated each time the timing pulse $T_1$ is generated.

In this way, the envlope waveform signal EV issued from the latch 4091 will is incremented sequentially by the value of the deviation data AT each time the data AT generates.

Through such repetitive calculation operations, the attack portion At of the envelop waveform signal EV is formed. As soon as the signal EV becomes equal to the attack level TL of the target value, the comparator 4080 will issue the compare result informtion COMP indicative of the equality, which cause the state control circuit 400 to generate the state signal $ST_1$ (refer to the step 102 in FIG. 12).

Next, during the state $ST_1$ duration, the first decay portion D1 (and the sustained portions ST only when the continuous envelope mode is specified) in the envelope waveform signal EV is formed. In this state or mode, the target value generator 401 will generate the first decay level signal 1DL and the selector 402 will generate the deviation data D1 (negative value). The arithmetic unit 408 will perform the similar operation to in the above state $ST_0$ on the basis of these data 1DL and D1 to form the first decay portion D1 in the signal EV.

And, if the current value of the envelope waveform signal EV arrives at the first decay level 1DL, in the continuous tone envelope mode the system will maintain the first decay level 1DL and move to the state corresponding to the continuous or sustained portion ST (see the step 121 in FIG. 12), whereas in the percussive envelope mode the system will move to the state $ST_2$ corresponding to the second decay portion D2 (see the step 106 in FIG. 12).

In the continuous envelope mode, the sustained portion ST is continued until the key-on signal KON is switched to the "0" level. As soon as the key-on signal KON is changed to the "0" state, the system will move to the state $ST_2$ corresponding to the second decay portion D2 (refer to the steps 103, 115 and 116 in FIG. 12).

In order to form the second decay portion D2 in the envelope waveform signal EV in the state $ST_2$, the target value generator 401 will generate the initial level signal IL and the selector 402 will generate the deviation data D2 (negative value). Even in the state $ST_2$, the similar operation to in the above state $ST_0$ will be executed to form the second decay portion D2 in the signal EV.

While forming the envelope waveform signal EV in the state $ST_0$, $ST_1$ or $T_2$, if the decay instruction signal DMP is generated, then the system will move unconditionally to the state $ST_3$ (refer to the steps 12, 115 and 118 in FIG. 12) to form the abrupt decay portion DM corresponding to the state $ST_3$.

When the slur switch S.SW is turned off and the legato key operation is carried out, the system will form the envelope waveform signal EV, in exactly the same manner as in the staccato playing operation or mode.

Explanation will next be made about the case where the slur switch S.SW is turned on and the legato playing operation is performed.

Figure 14:
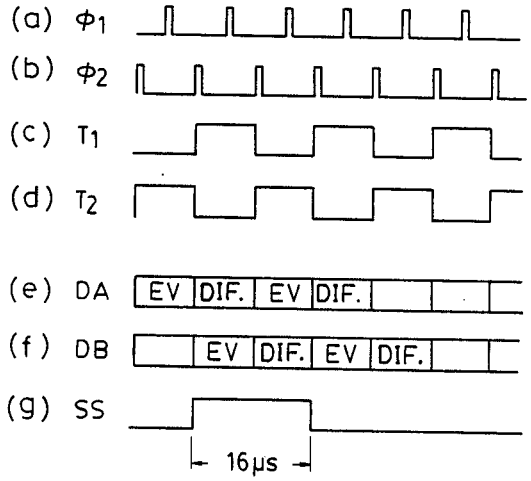
FIG. 14 is a timing chart for explaining the operation of the envelope generator of FIG. 11.

While forming the first decay portion D1 in the first key envelope waveform signal EV, if a second key is newly depressed, the depressed key detection circuit 2 will generate the slur start signal SS 10 us after the depression of the new second key. The slur start signal SS is issued during the duration of 16 us from the positive-going or rise edge on the timing pulse $T_1$, as shown by (g) in FIG. 14. As a result, the AND gate 4093 is satisfied with its logical AND conditions because the gate 4093 receives the slur start signal SS and the timing pulse $T_2$ during the generation period of the timing pulse $T_2$, resulting in the generation of the output singal $SST_2$ of a level "1" from the AND NAD gate 4093 during the pulse $T_2$ generation period. The output signal $SST_2$ is supplied from the AND gate 4093 to the AND gates 4083 and 4084 and also to the AND gates 4082 and 4085 via the inverter 4094. This causes the AND gates 4082 and 4085 to be closed while the AND gates 4083 and 4084 to be opened, in response to the generation of the signal $SST_2$. At this point, the AND gate 4083 also received at the othe input the first decay level 1DL' of the new second key from the target value generator 401. On the other hand, the AND gate 4084 also receives at the other input a dta D1Lx (complement value) to which the current value D1Lx at the first decay portion D1 of the envelope waveform signal EV is inverted by the inverter 4095.

Therefore, the AND gate 4083 will supply the first decay level signal 1DL' corresponding to the second key through the OR gate 4086 to the add input (A) of the adder 4088 in response to the generation of the signal $SST_2$. Also, the AND gate 4084 will supply the complement value D1Lx of the current value D1Lx of the signal EV via the OR gate 4087 to the add input (B) of the adder 4088 in response to the generation of the signal $SST_2$. On the other hand, the output signal $SST_2$ of the AND gate 4093 is applied directly to a carry input (Ci) of the adder 4088.

Under this condition, the adder 4088 will calculate the following logical expression according to the timing pulse $T_2$.

$$SD=(A)+(B)=1DL'-D1Lx$$

In other words, the adder will find the difference between the current value and target value of the envelope waveform signal EV according to the timing pulse $T_2$.

The adder will apply the calculated value SD or difference data to the A register 4089 in response to the generation of the timing pulse $T_1$. The A register 4089 in turn will generate the output data DA and supply it to the slur deviation data generator 407.

The slur deviation generator 407 receives the output data DA (=1DL'−D1Lx) in response to the generation of the timing pulse $T_1$ from the A register 4089 into a shift circuit 4070 contained in the generator 407. The shift circuit 4070 shits the input data DA, for example, 8 bits toward its lower order bit direction to multiply the data SA by 1/256. After this, the shift circuit will convert the input data DA multiplied by 1/256 with respect to its sign, according to a sign control signal SG from a slur data sign register 4096.

If the sign control signal SG has a level of "1", the shift circuit 4070 will complement the value "1/256.DA" and generate it as its negative value. On the other hand, when the signal SG has a level of "0", the shift circuit will issue the value "1/256.DA" without changing its sign. The value "1/256.DA" sign-controlled in this manner is applied from the shift circuit 4070 to an AND gate 4073. The AND gate 4073 also receives at the other input a slur clock signa SCL' from an oscillator 4071. The signal SCL' is used to determine the speed or rate at which the signal EV is sequentially varied to thereby make the current value of the signal EV equal to the target value of the second key. To this end, the signal SCL' is generated in synchronism with the slur clock signal SCL produced from the slur clock oscillator 7 in FIG. 7, and can be adjusted in its period by controlling a variable resistance 4072.

Each time the AND gate 4073 receives the slur clock signal SCL' from the oscillator 4071, the gate 4073 will send the value "1/256.DA" as the slur deviation data SL from the shift circuit 4070 to the selector 402. Now, the selector 402 also receives the state signal $ST_1$ and slur pitch start signal SPS from the state control circuit 400 (refer to the step 120 in FIG. 13), and thus the selector 402 will select and send the slur deviaion data SL to the AND gate 4081 in the arithmetic unit 408. This causes the AND gate 4081 in the arithmetic unit 408. This causes the AND gate 4081 to supply the slur deviation data SL to the AND gate 4085 at the time that the slur clock signal SCL' and the timing pulse $T_1$ are generated at the same time.

At this time, the AND gate 4093 generates the output signal $SST_2$ of level "0" because the slur start signal SS already disappears. This results in that the AND gates 4082 and 4085 are put in the conductive state or opened and that the slur deviation data SL is applied to the add input (B) of the adder 4088 via the AND gate 4085 and the OR gate 4087. On the other hand, the AND gate 4082 receives the output data DB(=D1Lz) from the B register 4090 in response to the generation of the timing pulse $T_1$. The data DB is also sent from the B register 4090 via the OR gate 4086 to the add input (A) of the adder 4088.

At this point, the output signal $SST_2$ supplied from the AND gate 4093 to the adder 4088 as its carry input signal is alredy "0" in level, and thus the adder will calculate the following logical expression when the pulse $T_1$ is generated.

$$SD=(A)+(B)\ D1Lx+SL$$

The calculation result SD is fed from the adder 4088 via the A and B registers 4089 and 4090 back to the add input (A) of the adder at the time when the next timing pulse $T_1$ is generated. And the adder 4088 will perform a logical sum operarion over (A) and (B) (that is, SD=(A)+(B)) as soon as the new timing pulse $T_1$ is generated.

Such a repetitive arithmetic operation at each generation time of the timing pulse $T_1$ will cause the output data DB of the B register 4090 to change sequentially by SL amount in accordance with the each generation period of the slur clock signal SCL'. The output data DB of the B register 4090 is applied to the latch 4090 which in turn latches it and issues as an envelope waveform signal EV varying sequentially in its amplitude.

After the calculation operation on the slur deviation data SL is performed 256($2^8$) times, the envelope waveform signal EV issued from the latch 4091 will arrive at the first decay level 1DL' corresponding to the new second key.

In response to it, the comparator 4080 will generate the compare result information COMP representative of the level equality. At this point, if the envelope mode is of the continuous tone, the stat control circuit 400 will maintain the state $ST_1$ until the key-on signal KON has a level of "0". As soon as the key-on signal KON is switched to the "0" level, the system will generate the state signal $ST_2$ to start to form the second decay portion D2~ If the envelope mode is of the percussive tone, on the other hand, when the system will generate the state signal $ST_2$ to start to from the second decay portion D2, immediately after the signal EV reaches the first decay level 1DL' corresponding to the second key.

In this way, the system will, in response to the generation of the slur start signal SS, calculate the difference between the current value of the first key envelope waveform signal EV and the target value (the first decay level 1DL') of a new second key signal EV, multiply the difference signal by 1/256 to generate the deviation data SL per unit time and sequentially add (or subtract, if SL is negative) the deviation dta SL to the current value of the first key signal EV. As a result, the signal EV can reach the target value through 256 calculation operations regardless of the difference amount between the current and target vales.

When receiving the first decay level signal 1DL' of the second key, the comparator 4080 will compare the first decay level 1DL' with the current value D1Lx of the envelope waveform signal EV of the first key. If the input signal at its A terminal is larger than the input signal at its B terminal, that is, if D1Lx is larger than 1DL', then the comparator will generate a compare result signal AGB which in turn is fed to an AND gare 4099 contained in a slur data sign register 4096. The AND gate 4099 in the register 4096 also receives at the other input the output signal $SST_2$ from the AND gate 4093 and sends the signal via an OR gate 4100 to a flop-flop 4101. The flip-flop 4101 is turn receives the output signal from the OR gate 4100 in response to the generation of the clock pulse $\phi_1$ and generates it in response to the generation of the clock pulse $\phi_2$. The output signal of the flip-flop 4101 is sent as a sign control signal SG to the slur deviation data generator 407 and also to an AND gate 4098. The gate 4098 also will receive at the other input the $SST_2$ to which the output signal $SST_2$ to which the output signal $SST_2$ of the AND gate 4093 in inverted by an inverter 4097, and will supply its output signal via the OR gate 4100 to the input terminal of the flip-flop 4101.

Therefore, after the output signal $SST_2$ is generated from the AND gate 4093, i.e., after a comparision is made between te target and current values of the signal EV, if the comparator 4080 generates the compare result signal AGB of level "1" indicative of the fact that the current value of the signal EV is greate than the target value thereof, then the flip-flop 4101 will receive the compare result signal AGB via the AND gate 4099 from the OR gate 4100 and in response to the generation of timing pulse $T_1$, will generate and send the sign control signal SG of leel "1" to the slur deviation data generator 407 and back to the input terminal of the flip-flop 4101 via the AND gate 4098 and the OR gate 4100, whereby the signal SG(AGB) is stored in the register 4096 until the next slur start signal generates. In this connection, if the compare result signal AGB has a level of "0", then the sign control signal SG of level "0" is stored in the slur sign register 4096.

While forming the attack portion At or sustained portion ST (only when the envelope mode is of the continuous tone) in the envelope waveform signal EV of the first key or forming the second decay portion (only when the envelope mode is of the percussive tone), if the system generates a slur start signal SS (refer to the steps 101 and 108 in FIG. 12), then exactly the same operation as in the foregoing is carried out and thus the explanation thereof it omitted.

As has been disclosed in the foregoing, the electronic musical instrument according to the present invention can generate envelope waveform signals EV which are different in waveform depending upon the key operating condition and the tone-color parameter information and which are controlled in amplitude according to the pitch of depressed keys.

Although the adder 4088 has been used as a subtracter only when the slur start signal SS generates in FIG. 11 in order to find calcuate or the difference between the current and target values of the first key signal EV in the legato playing mode, the difference calculation may be effected by use of a separate subtracter, if necessary.

Further, the slur control unit 5 shown in FIG. 1 may be replaced by the equivalent disclosed, for example, in Japanese Patent Appln. Laid-Open Publication No. 107722/1979.

Furthermore, the musical-tone signal generating circuit 5 may be of any musical-tone generating tupe including a frequency modulation, a waveform memory/-read, and a synthesizer.

In order to impart the slur effect, the pitch of the generated musical tone has been adjusted by changing its frequency information F in this embodiment. However, for the same purpose, the musical tone pitch may be adjusted in various other ways, for example, by changing its key code (as disclosed in Japanese Patent Appln. Laid-Open No. 1014/1978, corresponding to U.S. Pat. No. 4,237,764) or by changing its pitch voltage. In short, the musical one pitch may be adjusted by changing any of the parameters which determine the pitch of the generated musical tone.

Though the above explanation has been directed to the case where the invention is applied to an electronic musical instrument capable of playing a single tone with higher tone priority in the above embodiment, the invention may also be applied to an electronic musical instrument capable of playing a single tone with lower tone priority or the latest key priority or alternatively of playing compound tones.

The slur effect has been imparted in the illustrated embodiment only when the slur switch is turned on and the legato playing operation is performed, but it will be understood that the invention is not limited to that embodiment and the slur effect may be imparted regardless of the key playing operation on the keybord, if required.

As has been disclosed in the foregoing, the electronic musical instrument in accordance with the present invention allows a variation of amplitude coefficient of a musical tone according to variations in this pitch for its volume level control, whereby the slur effect similar to by a natural instrument such as a guitar can be realized which is also natural to listeners.

While the present invention has been explained with reference to the preferred embodiment shown in the drawings, it should be understood that the invention is not limited to the embodiment but covers all other possible modifications, alternatives, and equivalent arrangements included in the scope of the appended claims. Especially, the tone generation system is not limited to the disclosed one where a frequency information is utilized to access a waveshape memory. The invention is also applicable to a key code type tone generation system as disclosed in the U.S. Pat. No. 4,237,764, a pitch voltage type as disclosed in the U.S. Pat. No. 3,886,836 and a FM tone synthesis type as disclosed in the U.S. Pat. No. 4,018,121. In each case, a parameter which determines a pitch of a produced musical tone can be controlled in a manner according to the present invention.

What is claimed is:

1. An electronic musical instrument, comprising:

musical tone signal generating means for generating a musical tone signal gradually changing in musical tone pitch from that corresponding to a firstly-depressed key to that corresponding to a secondly-depressed second key in a keyboard;

amplitude generating means for generating an amplitude coefficient gradually varying from a first amplitude coefficient for the musical tone generated by the first key to a second amplitude coefficient for the musical tone generated by the second key, said gradual variation in amplitude ceefficient being coordinated with said gradual variation in said musical tone signal; and musical tone signal control means for controlling the amplitude of the musical tone signal generated by said musical tone signal generating means in accordance with the varying ampllitude coefficient generated by said amplitude coefficient generating means to thereby produce a musical tone signal varying gradually in amplitude in coordination with the variation in pitch of the musical tone.

2. An electronic musical instrument according to claim 1, wherein said musical instrument further comprises a depressed-key detection circuit for detecting successively depressed keys of the keyboard to thereby generate key information indicative of the pitches of said successively depressed keys, and said musical tone signal generating means generates a musical tone signal varying at a selected rate in a predetermined time from a pitch corresponding to the first key to a pitch corresponding to the second key in accordance with respective first and second key information corresponding to said first and second keys.

3. An electronic musical instrument according to claim 2, wherein said musical tone signal generating means comprises a first circuit for calculating the difference between said first key information and said second key information, a second circuit for multiplying said difference by $\frac{1}{2}^N$ (N is a positive integer), a third circuit for generating a clock pulse of a selected frequency, a fourth circuit for sequentially adding or subtracting the $\frac{1}{2}^N$ multiplied value of said difference obtained by said second circuit to or from said first key information in synchronism with the clock pulse generated from said third circuit to thereby form a third key information sequentially varying from the first key information to the second key information, and a fifth circuit for generating a musical tone signal sequentially varying at a rate corresponding to said difference from the pitch of the first key to that of the second key in accordance with the third key information generated by said four $T_2$ circuit.

4. An electronic musical instrument according to claim 1, wherein said amplitude coefficient generating means comprises a first circuit for calculating the difference between said first amplitude coefficient and said second amplitude coefficient, a second circuit for multiplying said difference by $\frac{1}{2}^N$ (N is a positive integer), a third circuit for generating a clock pulse of predetermined frequency, and a fourth circuit for sequentially adding or subtracting the $\frac{1}{2}^N$ multiplied value of said difference obtained by said second circuit to or from said first amplitude coefficient in synchronism with the clock pulse generated from said third circuit to thereby generate a third amplitude coefficient sequentially varying at a rate corresponding to said difference from said first amplitude coefficient to said second amplitude coefficient.

5. An electronic musical instrument according to claim 1, wherein said first and second amplitude coefficients are different corresponding to the pitches of the first and second keys.

6. An electronic musical instrument, comprising:

depressed-key detecting means for detecting depressed key or keys in a keyboard to thereby generate key information corresponding to said depressed key;

musical tone signal generating means for generating a musical tone signal varying from a pitch of a first key to that of a second key in accordance with a first key information corresponding to the firstly-depressed first key and a second key information corresponding to the secondly-depressed second key;

amplitude coefficient setting means for setting a plurality of amplitude coefficients for the pitches of the respective keys in a keyboard to thereby respectively generate said amplitude coefficients corresponding to the key information indicative of the depressed keys generated from said depressed-key detecting means;

amplitude coefficient forming means for forming a third amplitude coefficient sequentially varying from a first amplitude coefficient to a second amplitude coefficient in accordance with the first amplitude coefficient corresponding to said first key and the second amplitude coefficient corresponding to said second key; and musical tone control means for controlling an amplitude of the musical tone signal generated by said musical tone generating means in accordance with said third amplitude coefficient to thereby produce a musical tone signal varying in the amplitude as the pitch varies.

7. An electronic musical instrument according to claim 6, wherein said amplitude coefficient setting means sequentially sets said amplitude coefficients to smaller values toward the keys of high pitch.

8. An electronic musical instrument comprising;

depressed-key detection means for detecting a depressed key in a keyboard to thereby generate a key information corresponding thereto;

musical tone signal forming means for forming a musical tone signal varying from a pitch of a first key to that of a second key in accordance with a first key information corresponding to the firstly-depressed first key and a second key information corresponding to the secondly-depressed second key;

amplitude coefficient target value generating means for respectively setting a plurality of amplitude coefficient target values corresponding to the pitches of the respective keys to thereby respectively generate amplitude coefficient target values corresponding to the key information indicative of the depressed keys generated from said depressed-key detection means;

amplitude coefficient forming means for forming an amplitude coefficient for varying an amplitude of the musical tone signal in accordance with a plurality of target values generated from said amplitude coefficient target value generating means in response to depressed keys in said keyboard; and control means for controlling the amplitude of the musical tone signal in accordance with an amplitude coefficient sequentially varying from a first amplitude coefficient corresponding to the first key at the time of depressing said second key to a second amplitude coefficient corresponding to one of a plurality of target values for said second key.

9. An electronic musical instrument according to claim 8, wherein said plurality of target values set by said amplitude coefficient target value generating means are values corresponding to an attack level, first decay level, and second decay level.

10. An electronic musical instrument according to claim 9, wherein one of a plurality of target values corresponding to said second key used in said control means corresponds to said first decay level.

11. An electronic musical instrument according to claim 8, wherein a plurality of target values set in said amplitude coefficient target value generating means are sequentially set to smaller values toward the keys having high pitch.

12. An electronic musical instrument according to claim 8, wherein said amplitude coefficient forming means comprises a circuit for adding repeatedly a predetermined value until the present value of the amplitude coefficient reaches a predetermined target value at a predetermined speed.

13. An electronic musical instrument according to claim 8, wherein said control means comprises a first circuit for calculating the difference between the present value of the amplitude coefficient at the time of depressing said second key and a target value corresponding to the first decay level generated from said amplitude coefficient target value generating circuit corresponding to said second key, a second circuit for multiplying the calculated value of said first circuit by $\frac{1}{2}^N$(N is a positive integer), a third circuit for generating a clock pulse of predetermined period, and a fourth circuit for adding or subtracting the multiplied value of said second circuit to or from said present value in synchronism with the output pulse of said third circuit means.

14. An electronic musical instrument according to claim 13, wherein said second circuit comprises two registers which input the output of said first circuit, shift the output by N bits toward the lower significant side and output the resultant shifted value.

15. An electronic musical instrument, comprising:

first key operation detection means for detecting a first key operation in which a second key is depressed while a firstly-depressed key is depressed;

second key operation detecting means for detecting a second key operation in which the second key is depressed after the firstly-depressed key is released; and musical tone signal forming means for forming a first musical tone signal sequentially varying in pitch from the pitch of said first key to that of said second key and varying in amplitude upon variation of pitch when said first key operation is detected by said first key operation detection means and for forming a second musical tone signal of the pitch corresponding to the depressed key when said second key operation is detected by said second key operation detection means.

16. An electronic musical instrument according to claim 15, wherein said first key operation detection means comprises first memory for storing an any-key-ON signal when any of the keys is depressed, means for detecting the difference or equality between a previously depressed key and a newly depressed key, and a second memory for storing a signal when the any-key-ON signal is stored in said first memory and the previously depressed key is different from the newly depressed key, whereby when the any-key-ON signal is stored in said second memory, it is judged as being the first key operation.

17. An electronic musical instrument according to claim 15, wherein said second key operation detection means comprises a third memory for storing an any-key-ON signal when any of the keys is depressed, and a fourth memory for storing a new-key-ON signal when a new key is depressed in the case where the any-key-ON signal is not stored in said third memory, whereby when the new-key-ON signal is stored in said fourth memory, it is judged as being the second key operation.

18. An electronic musical instrument according to claim 15, wherein said musical tone signal forming means is selectively set in a first mode for forming a continuous musical tone signal and a second mode for forming a percussive musical tone signal.

19. An electronic musical instrument according to claim 18, together with effect selecting means for selecting the impartation of a slur effect by enabling said musical tone signal forming means to form said first musical tone signal, and wherein said musical tone forming means can take a first state that the amplitude of the musical tone signal is increased abruptly to an attack level, a second state that the amplitude of the musical tone signal is damped or increased from the attack level or a predetermined level to the first decay level, a third state that the amplitude of the musical tone signal is damped from said first decay level to a second decay level, and a fourth state that the amplitude of the musical tone signal is damped abruptly from said second decay level to an initial level, whereby said first state is achieved by an attack start signal generated upon starting of key depression, said second state is achieved by the end of said first state of the impartion of said slur effect, said third state is achieved when said second mode is selected, and said fourth state is achieved when all the keys are released.

20. An electronic musical instrument according to claim 19, wherein said musical tone signal forming means shifts to the second state in the case that the second key is depressed when the effect is selected by said effect selecting means and the control state of the musical tone signal corresponding to said first key is in the second state or third state.

21. An electronic musical instrument according to claim 20, wherein said musical tone signal forming circuit comprises musical tone signal forming circuit for forming a musical tone signal sequentially varying at the pitch from the pitch of said first key to that of said second key, whereby said musical tone signal forming circuit starts the operation of said musical tone signal forming circuit when the effect is selected by said effect selecting means and the first key operation is detected by said first key operation detection means.

22. A system for imparting a slur, portamento or glissando effect in an electronic musical instrument in which the pitches of two consecutively selected musical tones are established by frequency indicative data values and in which the envelope amplitude is established by an amplitude establishing value associated with each tone, said system comprising:

first means for sequentially gradually varying the frequency indicative data at a preset clock rate between the frequency indicative data value associated with the first of said two consecutively selected musical tones and the frequency indicative data value associated with the second of said two consecutively selected musical tones, and second means for sequentially gradually varying the envelope amplitude establishing values of the musical tone generated by said instrument between an amplitude establishing value associated with the first of said two consecutively selected musical tones and a target amplitude establishing value associated with the second of said consecutively selected musical tones, in concurrence with said sequential gradual variation of said frequency indicative data, so that the musical tone produced by said electronic musical instrument varies smoothly between the pitch of said first and second selected musical tones and concurrently smoothly varies in amplitude between the amplitudes thereof.

23. A system according to claim 22 wherein the envelope amplitude imparted to each musical tone includes an intial attack portion followed by one or more decay portions, and wherein said concurrent gradual variation in envelope amplitude terminates when the varying amplitude establishing value reaches a value corresponding to that of one of said one or more decay portions of the envelope associated with said second musical tone.

* * * * *